US011066214B2

(12) United States Patent
Nakamura

(10) Patent No.: US 11,066,214 B2
(45) Date of Patent: Jul. 20, 2021

(54) ADDITIVE CONTAINER

(71) Applicant: SEIKO EPSON CORPORATION, Tokyo (JP)

(72) Inventor: Shuichiro Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/827,787

(22) Filed: Mar. 24, 2020

(65) Prior Publication Data

US 2020/0307870 A1 Oct. 1, 2020

(30) Foreign Application Priority Data

Mar. 26, 2019 (JP) ..... JP2019-058738

(51) Int. Cl.
*B65D 47/04* (2006.01)

(52) U.S. Cl.
CPC ..... *B65D 47/046* (2013.01)

(58) Field of Classification Search
CPC ..... B65D 47/046; G03G 15/087
USPC ..... 222/153.14
See application file for complete search history.

(56) References Cited

U.S. PATENT DOCUMENTS 3,915,208 A * 10/1975 Anderson ..... G03G 15/0886 141/363
4,060,105 A * 11/1977 Feldeisen ..... G03G 15/087 141/1
4,603,714 A * 8/1986 Marotta ..... G03G 15/0886 141/383
4,615,364 A * 10/1986 Kawata ..... G03G 15/0886 141/364
5,111,976 A * 5/1992 Ban ..... G03G 15/087 141/364
5,150,162 A * 9/1992 Saito ..... G03G 15/0867 399/223
5,593,068 A * 1/1997 Kitayama ..... G03G 15/0867 141/364
5,848,338 A * 12/1998 Okada ..... G03G 15/087 399/262
6,085,056 A 7/2000 Okada
6,249,654 B1 * 6/2001 Kurz ..... G03G 15/087 399/12

(Continued)

FOREIGN PATENT DOCUMENTS

JP 59-077151 U 5/1984
JP 10-207205 A 8/1998
JP 2016-133654 A 7/2016

*Primary Examiner* — Michael J. Melaragno
(74) *Attorney, Agent, or Firm* — Global IP Counselors, LLP

(57) ABSTRACT

An additive container is configured to contain an additive to be added to a defibrated material therein and to be coupled to an intake port for introducing the additive of an additive supply device. The additive container includes a container that includes a discharge port and contains the additive, and a first shutter member that opens and closes the discharge port. The first shutter member enters an open state by rotating the container in a first direction around a central axis of the discharge port with respect to the first shutter member, and the first shutter member enters a closed state by rotating the container in a second direction opposite to the first direction with respect to the first shutter member from the open state.

8 Claims, 12 Drawing Sheets

(56) References Cited

U.S. PATENT DOCUMENTS

| | | | | |
|---|---|---|---|---|
| 6,266,506 | B1 * | 7/2001 | Kurz | G03G 15/087 399/12 |
| 6,363,235 | B1 * | 3/2002 | Chiesa | G03G 15/087 141/346 |
| 6,421,518 | B1 * | 7/2002 | Floyd | G03G 15/087 399/258 |
| D475,397 | S * | 6/2003 | Harris | D18/43 |
| D482,059 | S * | 11/2003 | Harris | D18/43 |
| 2001/0008592 | A1 * | 7/2001 | Harris | G03G 15/0867 399/262 |
| 2004/0197118 | A1 * | 10/2004 | Elich | G03G 15/0886 399/258 |
| 2014/0227008 | A1 * | 8/2014 | Janssen | G03G 15/0886 399/258 |

* cited by examiner

ADDITIVE CONTAINER

The present application is based on, and claims priority from JP Application Serial Number 2019-058738, filed Mar. 26, 2019, the disclosure of which is hereby incorporated by reference herein in its entirety.

BACKGROUND

1. Technical Field

The present disclosure relates to an additive container.

2. Related Art

For example, as described in JP-A-2016-133654, a slide-type shutter mechanism that collects toner is disclosed. The shutter mechanism includes a main body side containing portion, a toner container coupled to the main body side containing portion, and a shutter provided in the main body side containing portion. The toner is discharged from the main body side containing portion by opening and closing the shutter.

Here, in recent years, a dry type sheet manufacturing apparatus that uses water as little as possible has been proposed for miniaturization and energy saving, in a sheet manufacturing apparatus. As a configuration for supplying an additive such as a resin to a defibrated material, a configuration has been devised in which a container that contains the additive is attached to and detached from the sheet manufacturing apparatus, and the additive is supplied into the sheet manufacturing apparatus in the mounted state.

Therefore, it is considered that the shutter mechanism described in JP-A-2016-133654 is applied to a portion of the sheet manufacturing apparatus to which a container is coupled.

However, when the shutter mechanism described in JP-A-2016-133654 is applied to the portion of the sheet manufacturing apparatus to which the container is coupled, there is a possibility that the powdery additive may adhere to the outer surface of the shutter, and the adhered additive may be scattered in the atmosphere.

SUMMARY

The present disclosure can be realized in the following aspect.

According to an aspect of the present disclosure, there is provided an additive container configured to contain an additive to be added to a defibrated material therein and to be coupled to an intake port for introducing the additive of an additive supply device. The additive container includes a container that includes a discharge port and contains the additive, and a first shutter member that opens and closes the discharge port. The first shutter member enters an open state by rotating the container in a first direction around a central axis of the discharge port with respect to the first shutter member, and the first shutter member enters a closed state by rotating the container in a second direction opposite to the first direction with respect to the first shutter member from the open state.

DESCRIPTION OF EXEMPLARY EMBODIMENTS

Hereinafter, an additive container according to the present disclosure will be described in detail with reference to a preferred embodiment shown in the accompanying drawings.

EMBODIMENT

Figure 1:
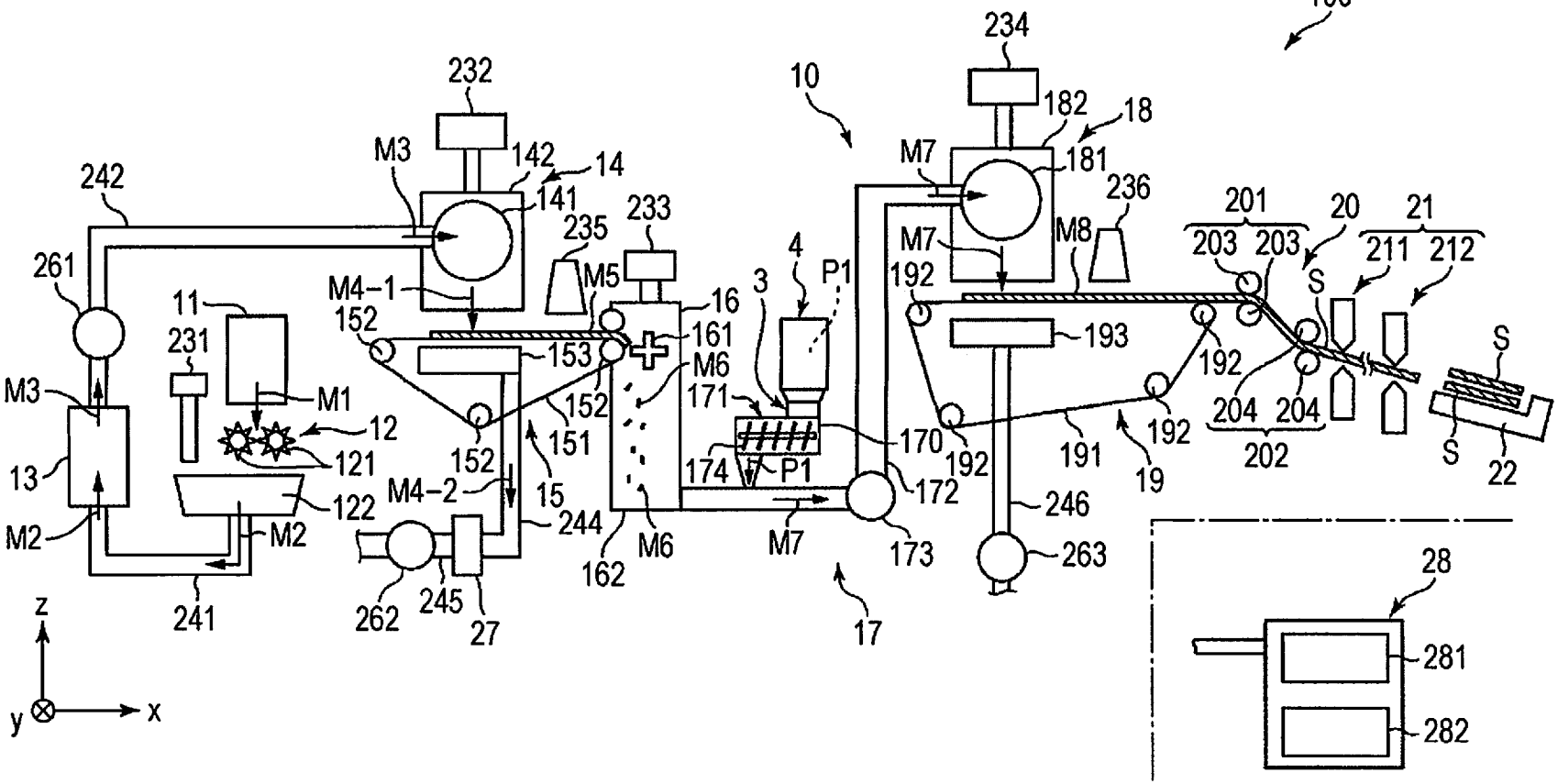
FIG. 1 is a schematic side view showing a sheet manufacturing apparatus according to an embodiment.
Figure 2:
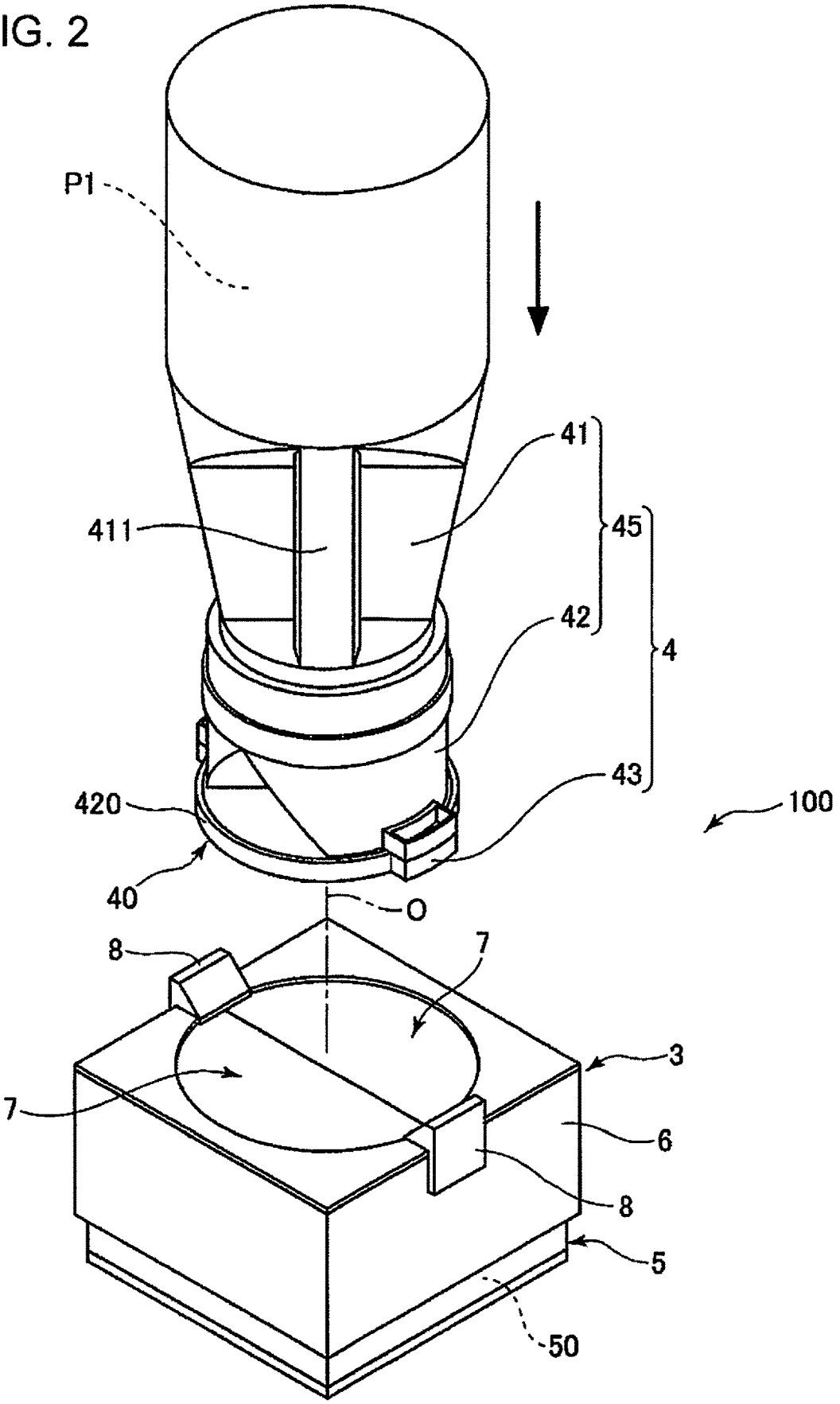
FIG. 2 is a perspective view showing an additive supply device and an additive container included in the sheet manufacturing apparatus shown in FIG. 1.
Figure 3:
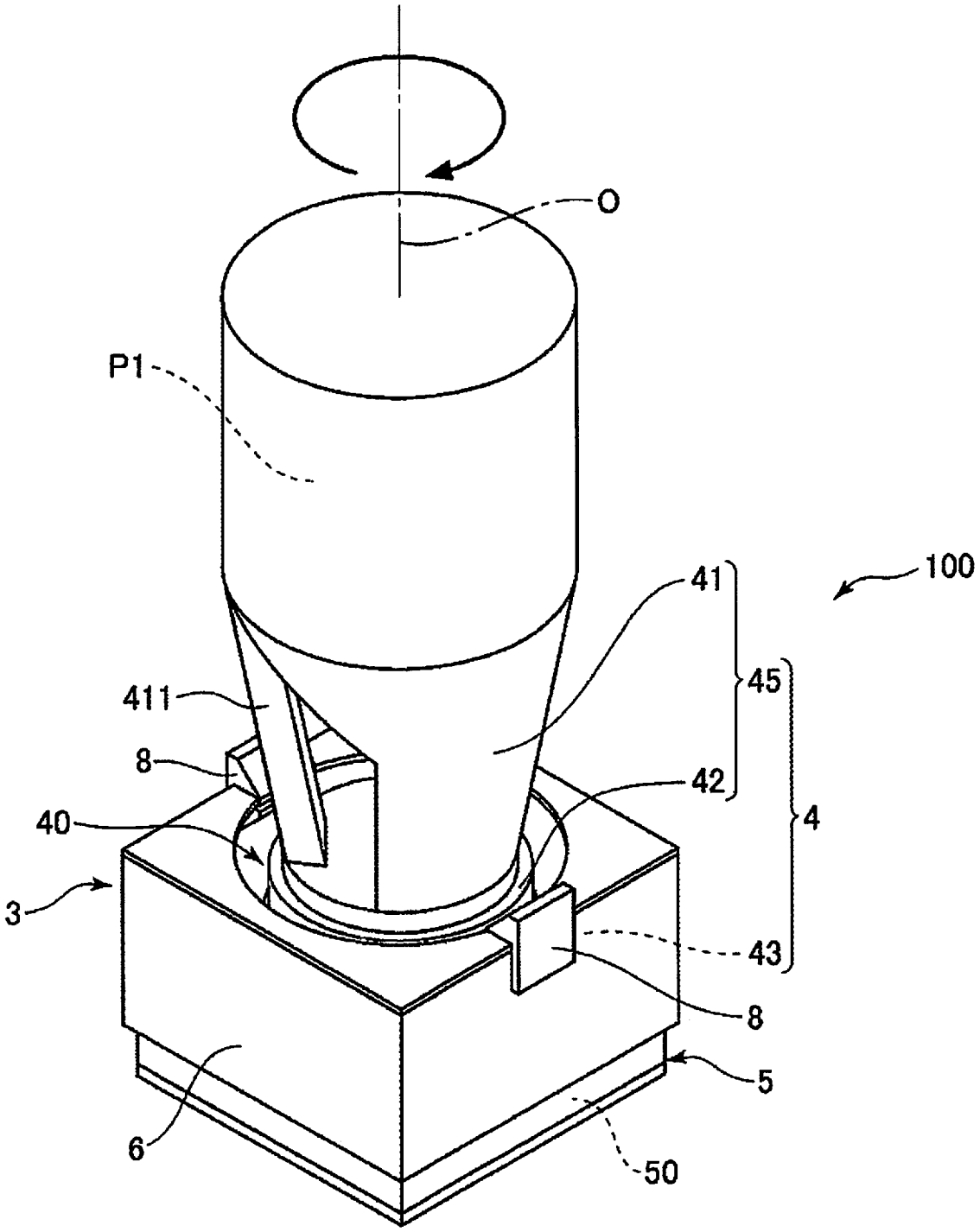
FIG. 3 is a perspective view showing the additive supply device and the additive container included in the sheet manufacturing apparatus shown in FIG. 1.
Figure 4:
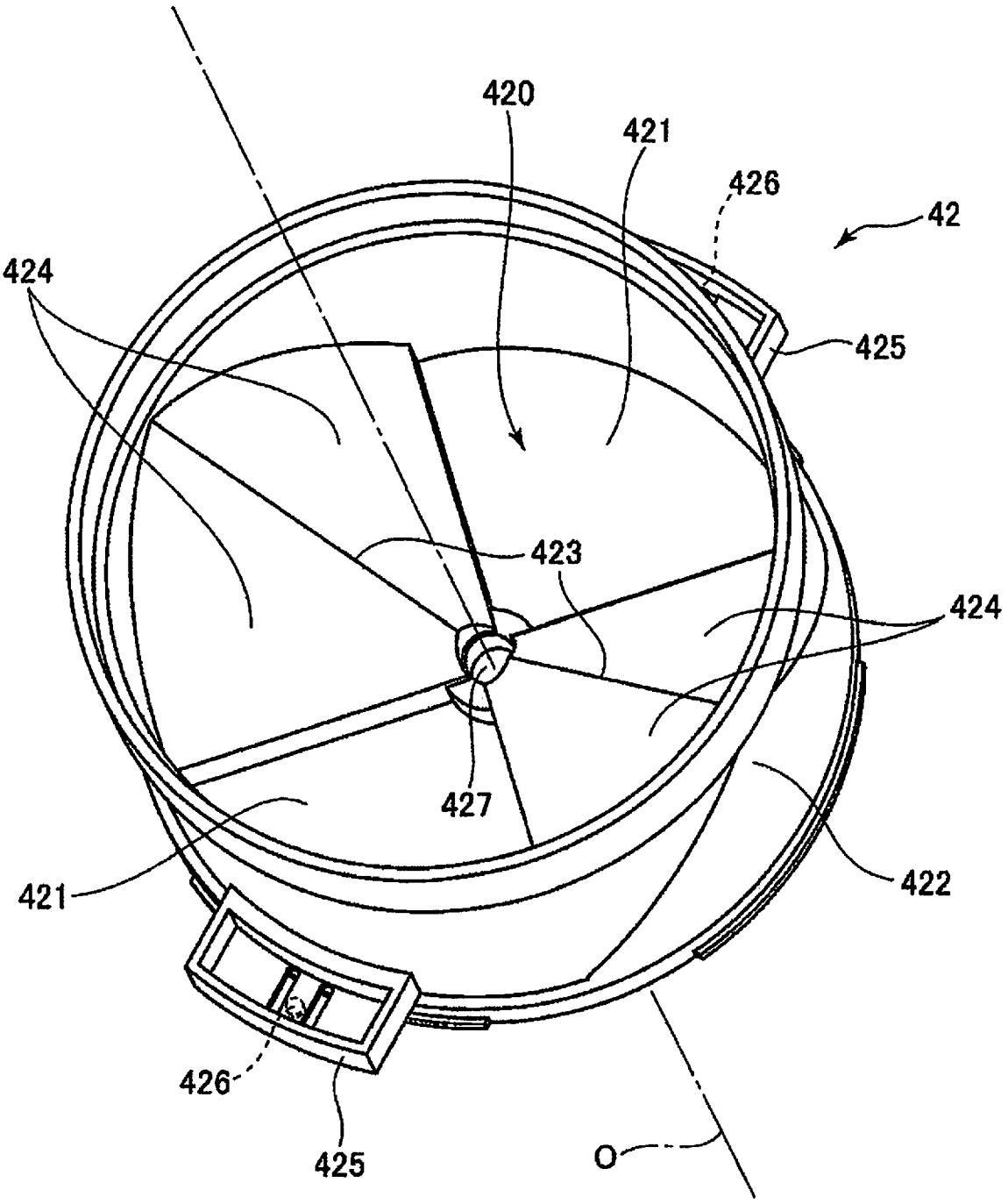
FIG. 4 is a perspective view showing a mouth member of the additive container shown in FIG. 2.
Figure 5:
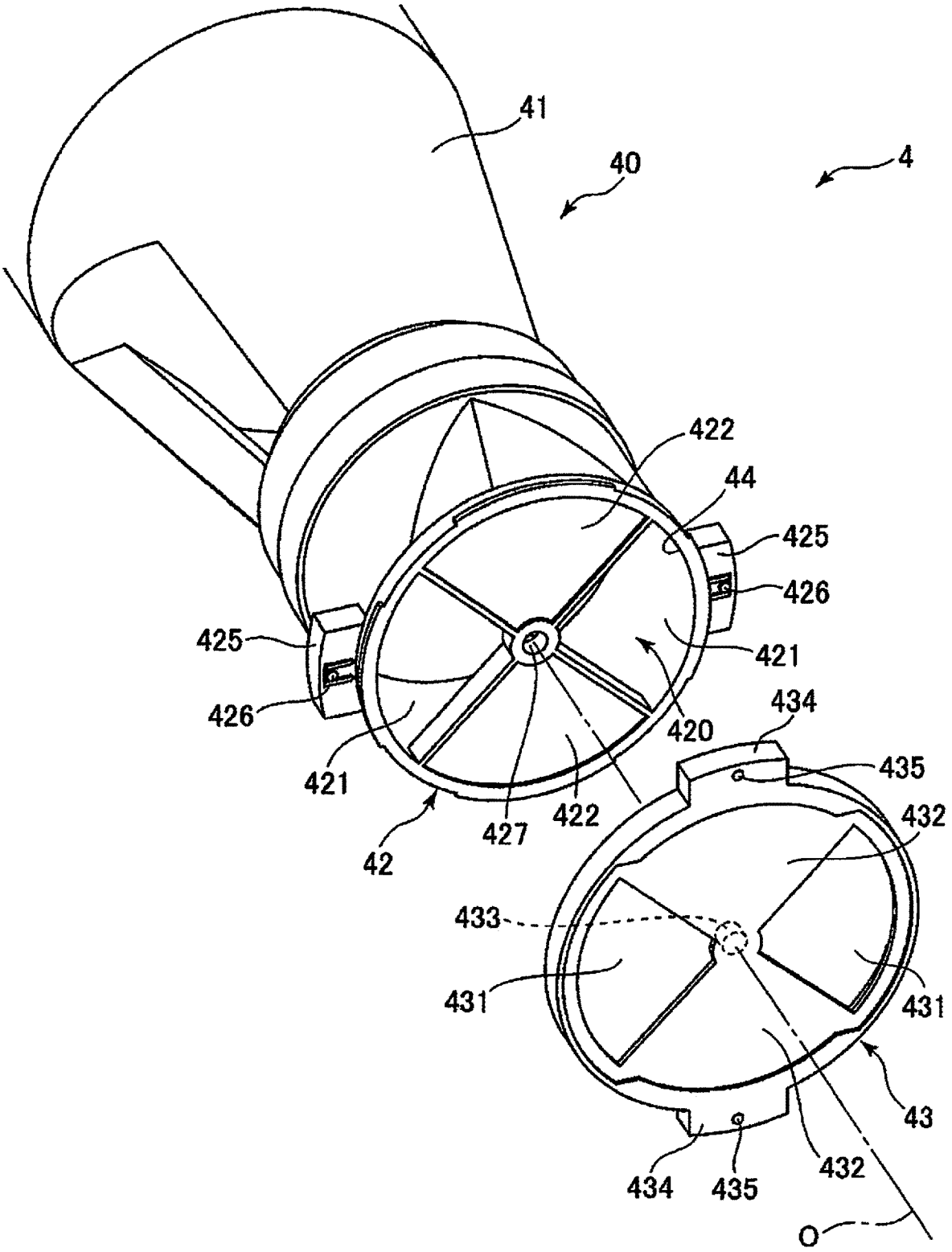
FIG. 5 is an exploded perspective view showing the mouth member and a first shutter member of the additive container shown in FIG. 2.
Figure 6:
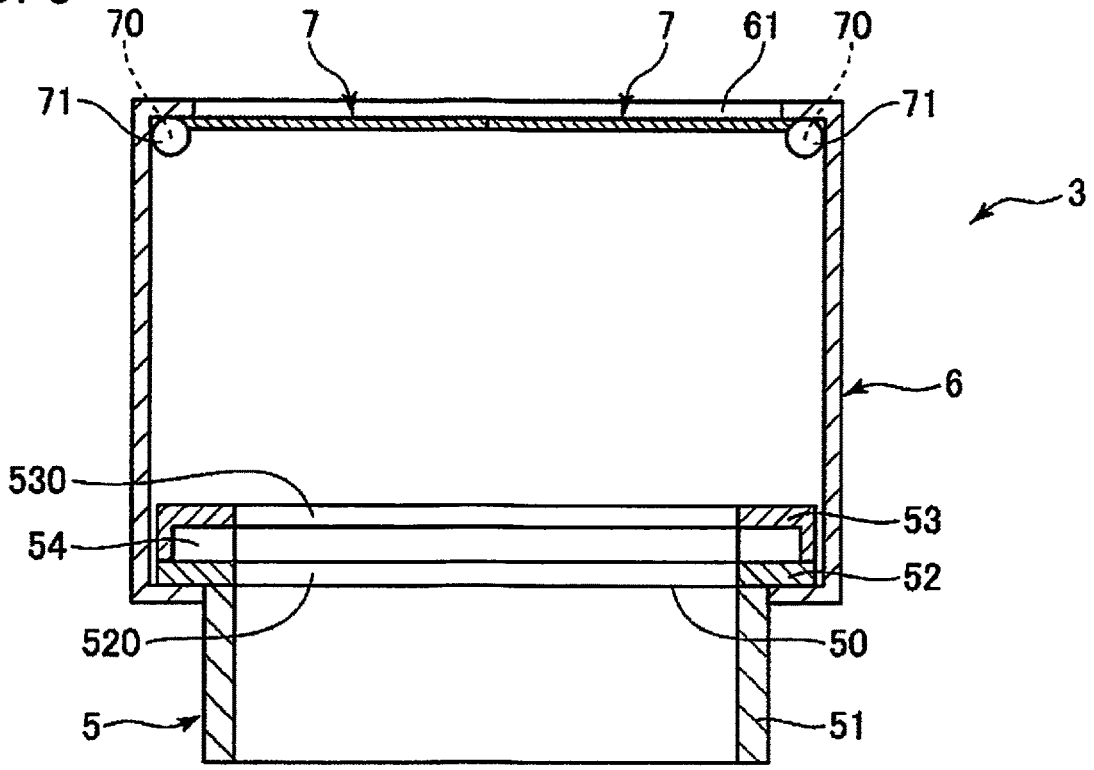
FIG. 6 is a longitudinal sectional view showing the additive supply device shown in FIG. 2.
Figure 7:
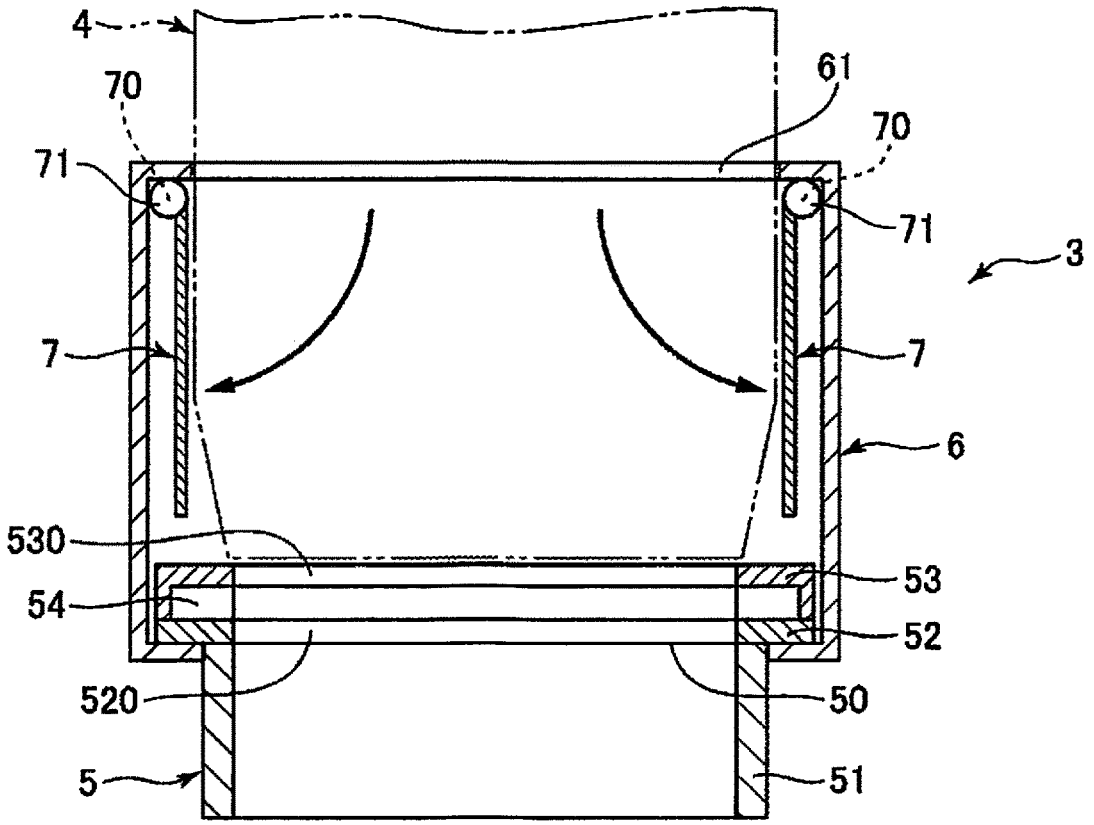
FIG. 7 is a longitudinal sectional view showing the additive supply device shown in FIG. 2.
Figure 8:
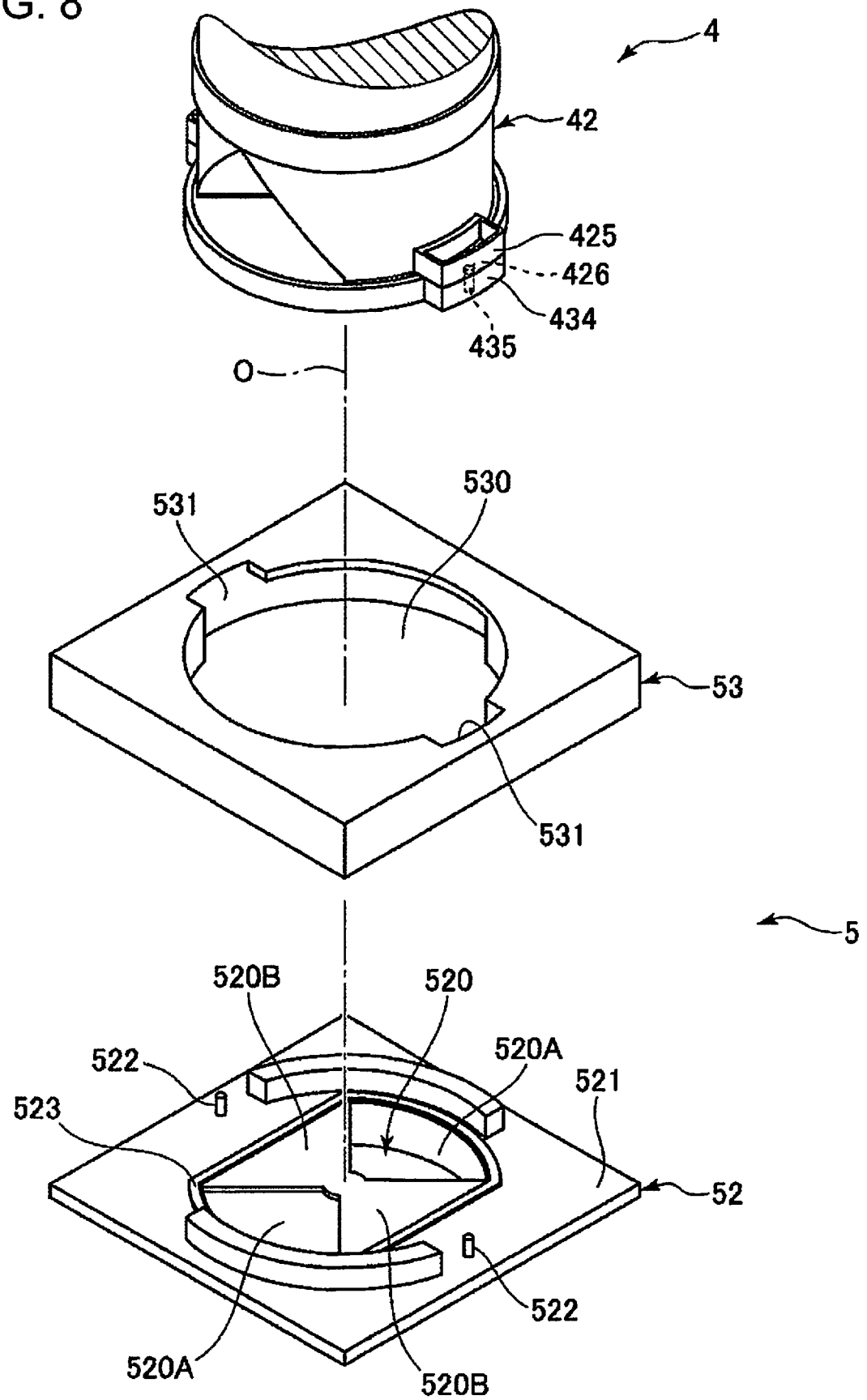
FIG. 8 is an exploded perspective view of a mounting portion included in the additive supply device shown in FIG. 2.
Figure 9:
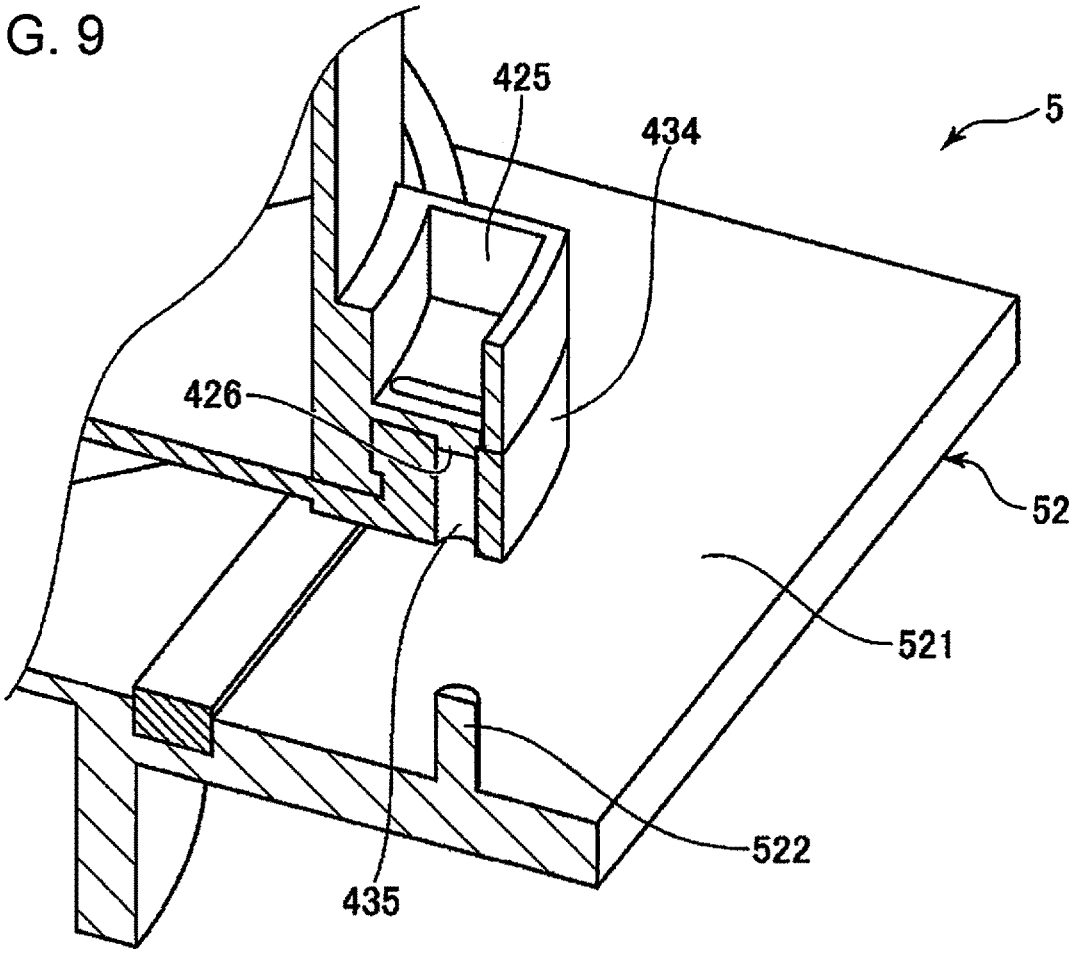
FIG. 9 is an enlarged longitudinal sectional view of the mounting portion shown in FIG. 8.
Figure 10:
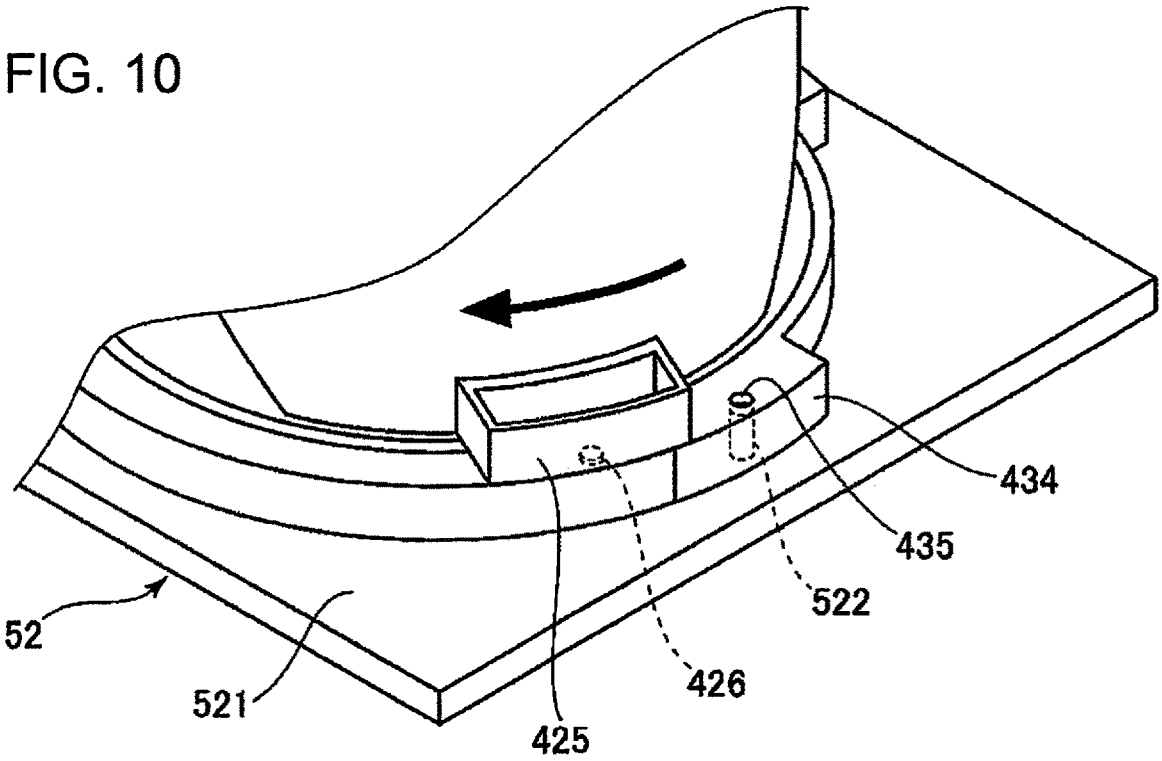
FIG. 10 is a perspective view of the mounting portion shown in FIG. 8.
Figure 11:
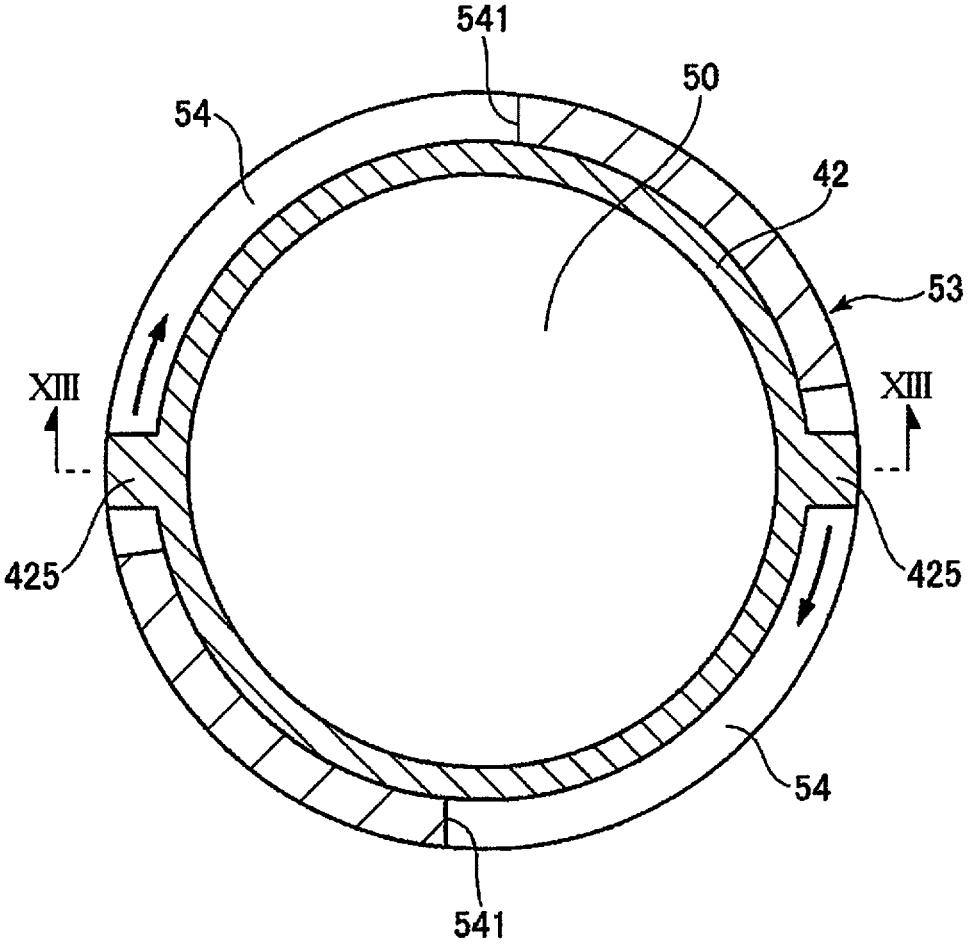
FIG. 11 is a cross-sectional view of the mounting portion shown in FIG. 8.
Figure 12:
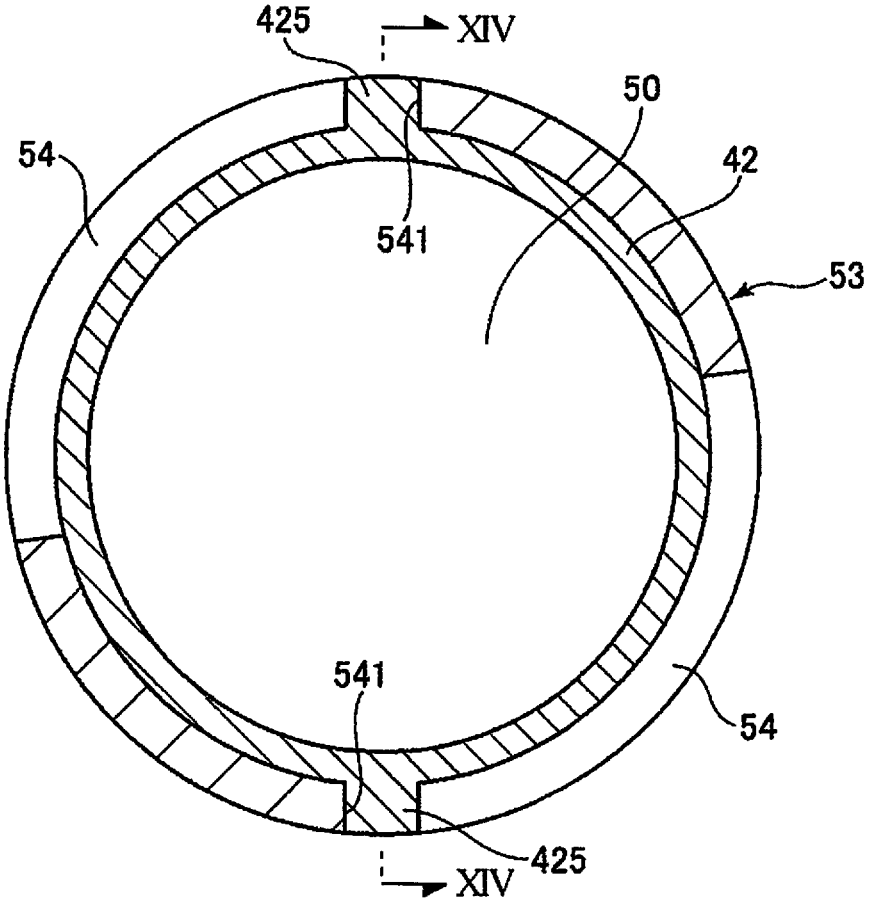
FIG. 12 is a cross-sectional view of the mounting portion shown in FIG. 8.
Figure 13:
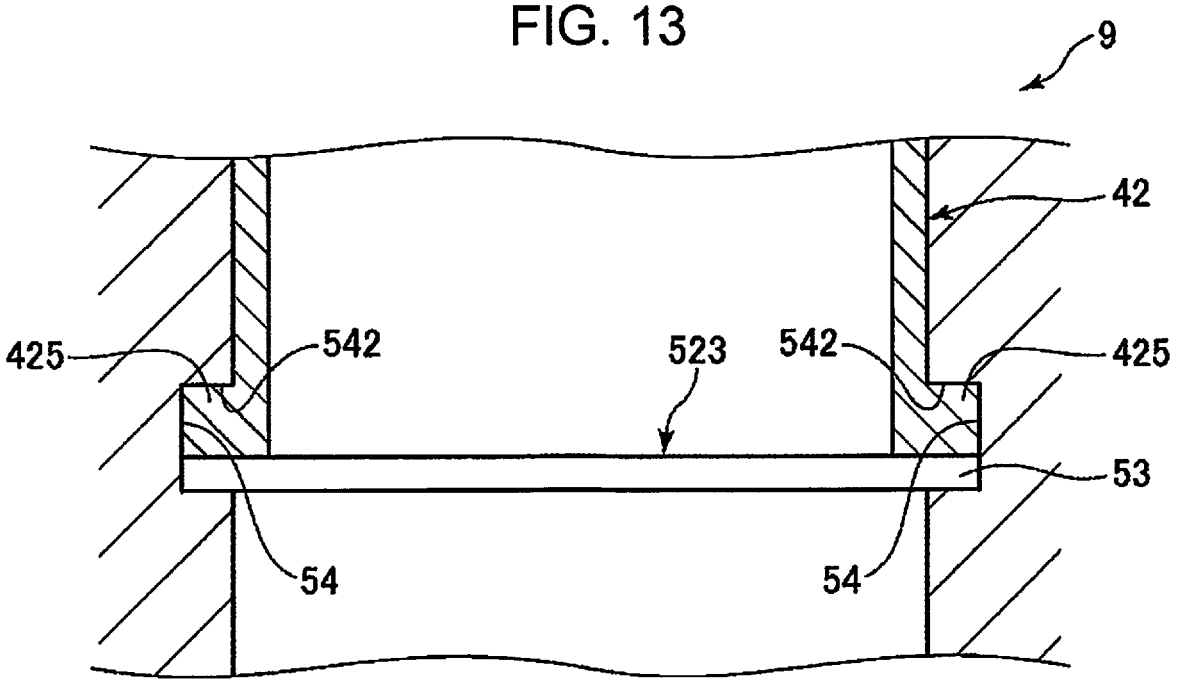
FIG. 13 is a cross-sectional view taken along line XIII-XIII in FIG. 11.
Figure 14:
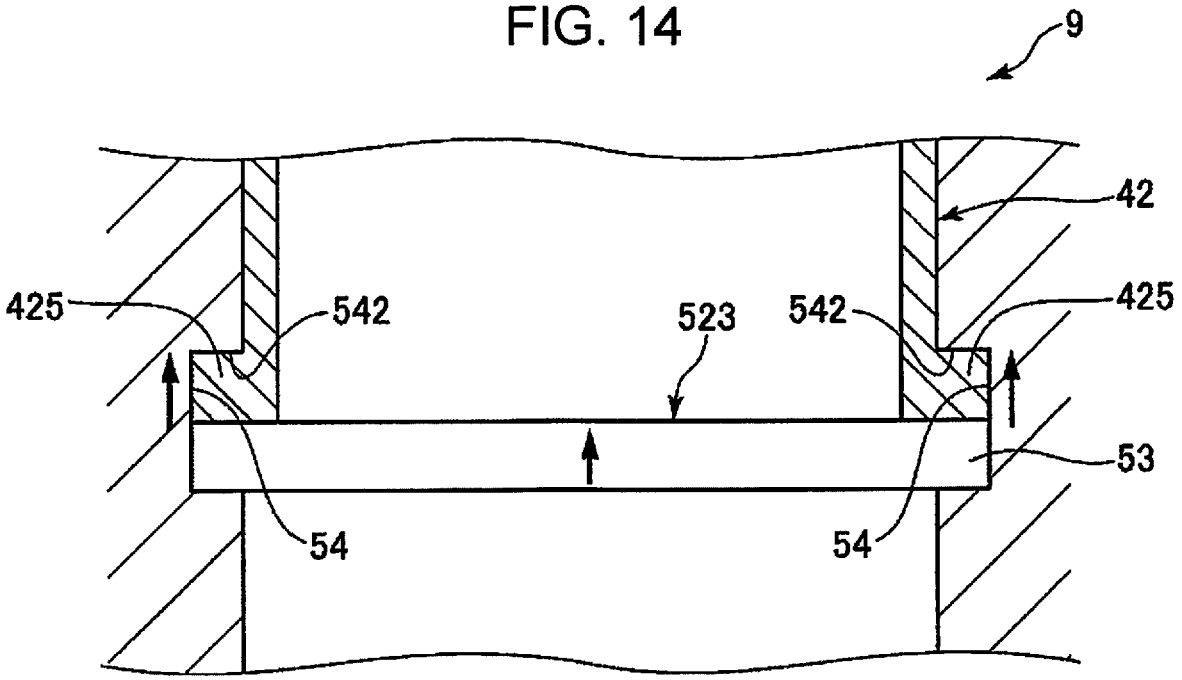
FIG. 14 is a cross-sectional view taken along line XIV-XIV in FIG. 12.

FIG. 1 is a schematic side view showing a sheet manufacturing apparatus according to an embodiment. FIG. 2 is a perspective view showing an additive supply device and an additive container included in the sheet manufacturing apparatus shown in FIG. 1. FIG. 3 is a perspective view showing the additive supply device and the additive container included in the sheet manufacturing apparatus shown in FIG. 1. FIG. 4 is a perspective view showing a mouth member of the additive container shown in FIG. 2. FIG. 5 is an exploded perspective view showing the mouth member and a first shutter member of the additive container shown in FIG. 2. FIG. 6 is a longitudinal sectional view showing the additive supply device shown in FIG. 2. FIG. 7 is a longitudinal sectional view showing the additive supply device shown in FIG. 2. FIG. 8 is an exploded perspective view of a mounting portion included in the additive supply device shown in FIG. 2. FIG. 9 is an enlarged longitudinal sectional view of the mounting portion shown in FIG. 8. FIG. 10 is a perspective view of the mounting portion shown in FIG. 8. FIG. 11 is a cross-sectional view of the mounting portion shown in FIG. 8. FIG. 12 is a cross-sectional view of the mounting portion shown in FIG. 8. FIG. 13 is a cross-sectional view taken along line XIII-XIII in FIG. 11. FIG. 14 is a cross-sectional view taken along line XIV-XIV in FIG.

Figure 15:
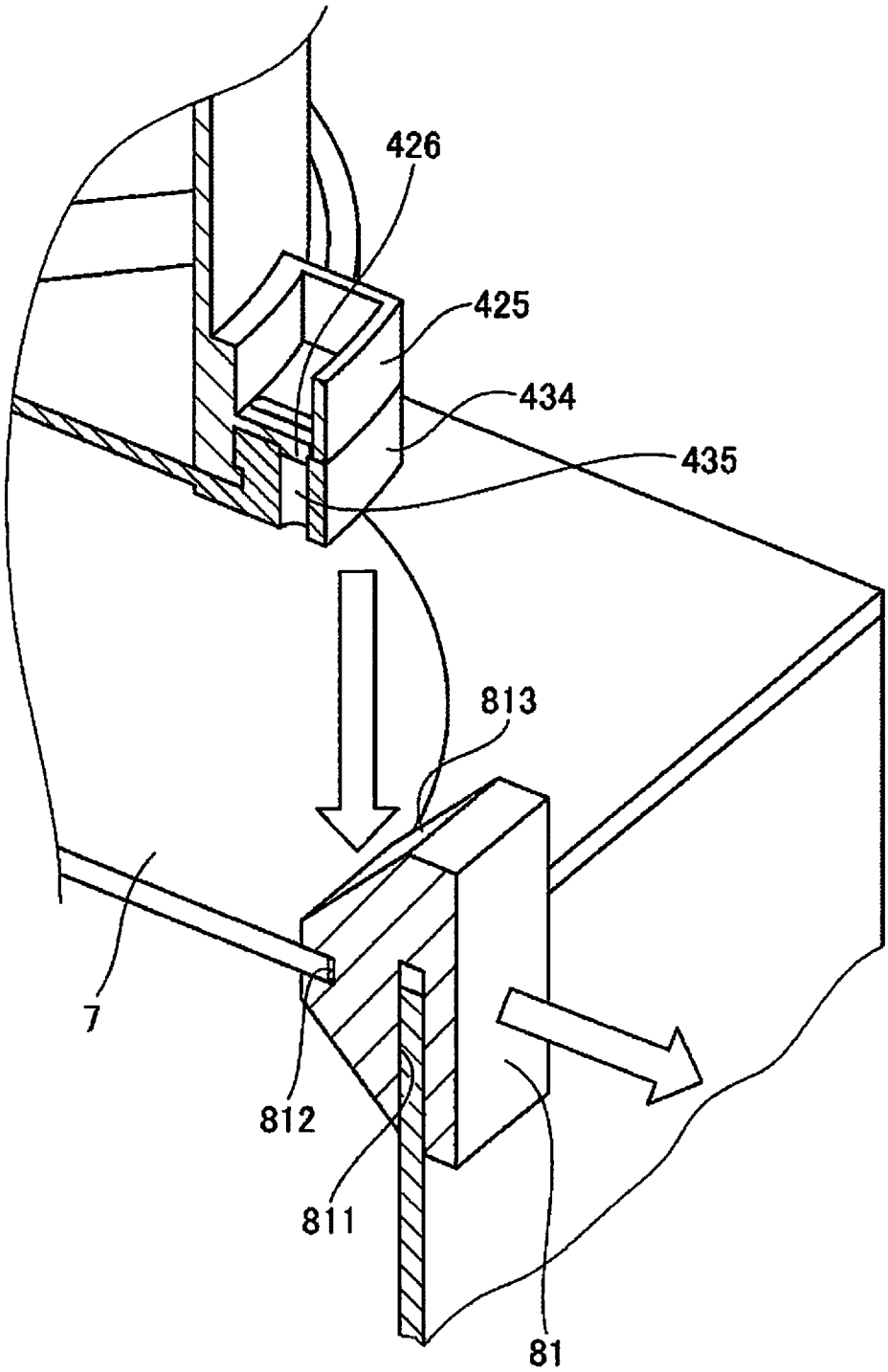
FIG. 15 is a perspective view showing a lock mechanism included in the additive supply device shown in FIG. 2.

12. FIG. 15 is a perspective view showing a lock mechanism included in the additive supply device shown in FIG. 2.

In the following, for convenience of description, as shown in FIG. 1, three axes orthogonal to each other are referred to as an x axis, a y axis, and a z axis. Further, an xy plane including the x axis and the y axis is horizontal, and the z axis is vertical. The direction in which the arrow of each axis is directed is referred to as "+", and the opposite direction is referred to as "-". In FIGS. 1 to 10 and FIGS. 13 to 15, an upper side may be referred to as "up" or "above", and a lower side may be referred to as "down" or "below".

As shown in FIG. 1, a sheet manufacturing apparatus 100 includes a raw material supply section 11, a crushing section 12, a defibrating section 13, a selecting section 14, a first web forming section 15, a subdividing section 16, an additive supply device 3, a mixing section 17, a loosening section 18, a second web forming section 19 that is a deposition section, a sheet forming section 20, a cutting section 21, a stock section 22, a collection section 27, and a controller 28. Further, each of the sections is electrically coupled to the controller 28, and the operation thereof is controlled by the controller 28. The additive supply device 3, the mixing section 17, and the second web forming section 19 constitute a web forming device 10.

Further, the sheet manufacturing apparatus 100 includes a humidifying section 231, a humidifying section 232, a humidifying section 233, a humidifying section 234, a humidifying section 235, and a humidifying section 236. In addition, the sheet manufacturing apparatus 100 includes a blower 261, a blower 262, and a blower 263.

Further, in the sheet manufacturing apparatus 100, a raw material supply process, a crushing process, a defibrating process, a selecting process, a first web forming process, a dividing process, a mixing process, a loosening process, a second web forming process, a sheet forming process, and a cutting process are executed in this order.

Hereinafter, the configuration of each section will be described.

The raw material supply section 11 performs the raw material supply process which supplies a raw material M1 to the crushing section 12. The raw material M1 is a sheet-like material which consists of a fiber-containing material containing a cellulose fiber. The cellulose fiber is not particularly limited as long as it is mainly composed of cellulose as a compound and has a fibrous shape, and the cellulose fiber may contain hemicellulose and lignin in addition to cellulose. Further, the raw material M1 may be in any form such as woven fabric or non-woven fabric. The raw material M1 may be, for example, recycled paper that is recycled and manufactured by defibrating used paper or YUPO paper (registered trademark) that is synthetic paper, or may not be recycled paper. In the present embodiment, the raw material M1 is used paper that has been used or that is no longer needed.

The crushing section 12 performs a crushing process of crushing the raw material M1 supplied from the raw material supply section 11 in the atmosphere or the like. The crushing section 12 has a pair of crushing blades 121 and a chute 122.

The pair of crushing blades 121 can rotate in mutually opposite directions to crush the raw material M1 between the crushing blades, that is, cut the raw material to form a crushing piece M2. The shape and size of the crushing piece M2 may be suitable for defibrating processing in the defibrating section 13, are preferably a small piece having a side length of 100 mm or less, and more preferably a small piece having a side length of 10 mm or more and 70 mm or less, for example.

The chute 122 is disposed below the pair of crushing blades 121 and has, for example, a funnel shape. Thereby, the chute 122 can receive the crushing piece M2 which is crushed by the crushing blade 121 and falls.

Further, the humidifying section 231 is disposed above the chute 122 so as to be adjacent to the pair of crushing blades 121. The humidifying section 231 humidifies the crushing piece M2 in the chute 122. The humidifying section 231 has a filter (not shown) containing moisture, and includes a hot air vaporization type humidifier that supplies humidified air with increased humidity to the crushing piece M2 by passing air through the filter. By supplying the humidified air to the crushing piece M2, it is possible to prevent the crushing piece M2 from adhering to the chute 122 and the like due to static electricity.

The chute 122 is coupled to the defibrating section 13 via a pipe 241. The crushing piece M2 collected on the chute 122 passes through the pipe 241 and is transported to the defibrating section 13.

The defibrating section 13 performs a defibrating process of defibrating the crushing piece M2 in the air, that is, in a dry manner. By the defibrating processing in the defibrating section 13, a defibrated material M3 can be generated from the crushing piece M2. Here, "defibrating" means that a fiber body formed by bonding a plurality of fibers, that is, a fiber body corresponding to the crushing piece M2 in the present disclosure, is unraveled into individual fibers. Then, the unraveled material is the defibrated material M3. The shape of the defibrated material M3 is linear or band shape. Further, the defibrated material M3 may exist in a state where the defibrated material is entangled and formed into a lump, that is, in a state of forming a so-called "ball".

In the present embodiment, for example, the defibrating section 13 includes an impeller mill having a rotary blade that rotates at a high speed and a liner that is located on the outer periphery of the rotary blade. The crushing piece M2 flowing into the defibrating section 13 is defibrated by being sandwiched between the rotary blade and the liner.

Further, the defibrating section 13 can generate a flow of air from the crushing section 12 toward the selecting section 14, that is, an air flow, by rotation of the rotary blade. Thereby, it is possible to suck the crushing piece M2 to the defibrating section 13 from the pipe 241. After the defibrating processing, the defibrated material M3 can be sent out to the selecting section 14 via the pipe 242.

The blower 261 is installed in the middle of the pipe 242. The blower 261 is an air flow generation device that generates an air flow toward the selecting section 14. Thereby, sending out the defibrated material M3 to the selecting section 14 is promoted.

The selecting section 14 performs the selecting process of selecting the defibrated material M3 according to the length of the fiber. In the selecting section 14, the defibrated material M3 is selected into a first selected material M4-1 and a second selected material M4-2 that is larger than the first selected material M4-1. The first selected material M4-1 has a size suitable for the subsequent manufacture of the sheet S. The average length is preferably 1 μm or more and 30 μm or less. Meanwhile, the second selected material M4-2 includes, for example, one in which defibration is insufficient, one in which the defibrated fibers are excessively aggregated, or the like.

The selecting section 14 includes a drum section 141 and a housing section 142 that houses the drum section 141.

The drum section 141 is a sieve that is formed of a cylindrical net body and that rotates around its central axis. The defibrated material M3 flows into the drum section 141.

As the drum section 141 rotates, the defibrated material M3 smaller than the opening of the net is selected as the first selected material M4-1, and the defibrated material M3 having a size equal to or larger than the opening of the net is selected as the second selected material M4-2 and collected at the collection section 27.

Further, the first selected material M4-1 from the drum section 141 falls while being dispersed in the air, and travels to the first web forming section 15 located below the drum section 141. The first web forming section 15 performs the first web forming process of forming a first web M5 from the first selected material M4-1. The first web forming section 15 has a mesh belt 151, three tension rollers 152, and a suction section 153.

The mesh belt 151 is an endless belt, and the first selected material M4-1 is deposited thereon. The mesh belt 151 is wound around three tension rollers 152. When the tension rollers 152 are rotationally driven, the first selected material M4-1 on the mesh belt 151 is transported toward downstream.

The first selected material M4-1 has a size equal to or larger than the opening of the mesh belt 151. Thereby, the first selected material M4-1 is restricted from passing through the mesh belt 151 and can thus be deposited on the mesh belt 151. Since the first selected material M4-1 is transported toward downstream with the mesh belt 151 in a state where the selected material is deposited on the mesh belt 151, the selected material is formed as the layered first web M5.

Further, there is a possibility that dust, dirt, and the like are mixed in the first selected material M4-1. Dust or dirt may be generated by crushing or defibration, for example. Such dust or dirt is collected at the collection section 27 which will be described later.

The suction section 153 is a suction mechanism that sucks air from below the mesh belt 151. Thereby, it is possible to suck the dust or dirt which has passed the mesh belt 151 with air.

The suction section 153 is coupled to the collection section 27 via a pipe 244. The dust or dirt sucked by the suction section 153 is collected at the collection section 27.

A pipe 245 is further coupled to the collection section 27. Further, the blower 262 is installed in the middle of the pipe 245. By the operation of the blower 262, a suction force can be generated at the suction section 153. Thereby, formation of the first web M5 on the mesh belt 151 is promoted. The first web M5 is formed by removing dust, dirt, and the like. Further, the dust or dirt passes through the pipe 244 and reaches the collection section 27 by the operation of the blower 262.

The housing section 142 is coupled to the humidifying section 232. The humidifying section 232 includes a vaporization type humidifier similar to the humidifying section 231. Thereby, the humidified air is supplied into the housing section 142. The first selected material M4-1 can be humidified with the humidified air, so that the first selected material M4-1 can be prevented from adhering to the inner wall of the housing section 142 due to electrostatic force.

The humidifying section 235 is disposed downstream of the selecting section 14. The humidifying section 235 includes an ultrasonic humidifier that sprays water. Thereby, moisture can be supplied to the first web M5, and thus the content of moisture of the first web M5 is adjusted. By the adjustment, adsorption of the first web M5 to the mesh belt 151 due to electrostatic force can be prevented. Thereby, the first web M5 is easily peeled from the mesh belt 151 at a position where the mesh belt 151 is folded back by the tension rollers 152.

The subdividing section 16 is disposed downstream of the humidifying section 235. The subdividing section 16 performs the dividing process of dividing the first web M5 peeled from the mesh belt 151. The subdividing section 16 has a propeller 161 that is rotatably supported and a housing section 162 that houses the propeller 161. Then, the first web M5 can be divided by the rotating propeller 161. The divided first web M5 becomes a subdivided body M6. Further, the subdivided body M6 descends in the housing section 162.

The housing section 162 is coupled to the humidifying section 233. The humidifying section 233 includes a vaporization type humidifier similar to the humidifying section 231. Thereby, the humidified air is supplied into the housing section 162. The humidified air can prevent the subdivided body M6 from adhering to the propeller 161 or the inner wall of the housing section 162 due to electrostatic force.

The mixing section 17 is disposed downstream of the subdividing section 16. The mixing section 17 performs the mixing process which mixes the subdivided body M6 and an additive. The mixing section 17 has an additive supply section 171, a pipe 172, and a blower 173.

The pipe 172 couples the housing section 162 of the subdividing section 16 and a housing section 182 of the loosening section 18 to each other and is a flow path through which a mixture M7 of the subdivided body M6 and the additive passes.

The additive supply section 171 is coupled in the middle of the pipe 172. The additive supply section 171 has a housing 170 and a screw feeder 174 provided in the housing 170. Further, the additive supply device 3 to which the additive container 4 is coupled is installed on the upper portion of the housing 170. These configurations will be described in detail later.

The additive supplied from the additive container 4 is supplied into the housing 170 via the additive supply device 3, and is supplied into the pipe 172 by the screw feeder 174 being rotationally driven. Thereby, the additive and the subdivided body M6 are mixed and the resulting mixture becomes the mixture M7.

Here, examples of the additive supplied from the additive container 4 include a binder for binding fibers, a colorant for coloring the fiber, an aggregation inhibitor for inhibiting aggregation of the fiber, a flame retardant for making the fiber difficult to burn, a paper strengthening agent for enhancing the paper strength of sheet S, a defibrated material, and the like, and these can be used alone or in combination. Hereinafter, the case where an additive is a binder will be described as an example. The additive includes a binder that bonds the fibers to each other, so that the strength of the sheet S can be increased.

Examples of the binder include a powdered or particulate resin P1. As the resin P1, for example, a thermoplastic resin, a curable resin, or the like can be used, but a thermoplastic resin is desirably used. Examples of the thermoplastic resin include an AS resin, an ABS resin, polyolefin such as polyethylene, polypropylene, or an ethylene-vinyl acetate copolymer (EVA), modified polyolefin, an acrylic resin such as polymethyl methacrylate, polyvinyl chloride, polystyrene, polyester such as polyethylene terephthalate and polybutylene terephthalate, polyamide (nylon) such as nylon 6, nylon 46, nylon 66, nylon 610, nylon 612, nylon 11, nylon 12, nylon 6-12, and nylon 6-66, polyphenylene ether, polyacetal, polyether, polyphenylene oxide, polyetheretherketone, polycarbonate, polyphenylene sulfide, thermoplastic polyimide, polyetherimide, a liquid crystal polymer such as aromatic polyester, various thermoplastic elastomers such as a styrene-based thermoplastic elastomer, a polyolefin-based thermoplastic elastomer, a polyvinyl chloride-based thermoplastic elastomer, a polyurethane-based thermoplastic elastomer, a polyester-based thermoplastic elastomer, a polyamide-based thermoplastic elastomer, a polybutadiene-based thermoplastic elastomer, a trans polyisoprene-based thermoplastic elastomer, a fluoro rubber-based thermoplastic elastomer, and a chlorinated polyethylene-based thermoplastic elastomer, and the like, and one or more selected from these can be used in combination. Desirably, as the thermoplastic resin, polyester or a composition containing the polyester is used.

In the middle of the pipe 172, the blower 173 is installed downstream of the additive supply section 171. The subdivided body M6 and the resin P1 are mixed by the action of a rotating portion such as a blade of the blower 173. Further, the blower 173 can generate an air flow toward the loosening section 18. With the air flow, the subdivided body M6 and the resin P1 can be stirred in the pipe 172. Thereby, the mixture M7 can flow into the loosening section 18 in a state where the subdivided body M6 and the resin P1 are uniformly dispersed. Further, the subdivided body M6 in the mixture M7 is loosened in the process of passing through the pipe 172, and has a finer fibrous shape.

The loosening section 18 performs the loosening process of loosening the mutually entangled fibers in the mixture M7. The loosening section 18 includes a drum section 181 and the housing section 182 that houses the drum section 181.

The drum section 181 is a sieve that is formed of a cylindrical net body and that rotates around its central axis. The mixture M7 flows into the drum section 181. When the drum section 181 rotates, fibers or the like smaller than the opening of the net in the mixture M7 can pass through the drum section 181. At that time, the mixture M7 is loosened.

The housing section 182 is coupled to the humidifying section 234. The humidifying section 234 includes a vaporization type humidifier similar to the humidifying section 231. Thereby, the humidified air is supplied into the housing section 182. The inside of the housing section 182 can be humidified with the humidified air, so that the mixture M7 can be prevented from adhering to the inner wall of the housing section 182 due to electrostatic force.

Further, the mixture M7 loosened in the drum section 181 falls while being dispersed in the air, and travels to the second web forming section 19 located below the drum section 181. The second web forming section 19 performs the second web forming process of forming a second web M8 from the mixture M7. The second web forming section 19 has a mesh belt 191, tension rollers 192, and a suction section 193.

The mesh belt 191 is an endless belt, and the mixture M7 is deposited thereon. The mesh belt 191 is wound around four tension rollers 192. When the tension rollers 192 are rotationally driven, the mixture M7 on the mesh belt 191 is transported toward downstream.

Further, most of the mixture M7 on the mesh belt 191 has a size equal to or larger than the opening of the mesh belt 191. Thereby, the mixture M7 is restricted from passing through the mesh belt 191 and can thus be deposited on the mesh belt 191. Since the mixture M7 is transported toward downstream with the mesh belt 191 in a state where the mixture is deposited on the mesh belt 191, the mixture is formed as the layered second web M8.

The suction section 193 is a suction mechanism that sucks air from below the mesh belt 191. Thereby, the mixture M7 can be sucked onto the mesh belt 191, and thus the deposition of the mixture M7 onto the mesh belt 191 is promoted.

A pipe 246 is coupled to the suction section 193. Further, the blower 263 is installed in the middle of the pipe 246. By the operation of the blower 263, a suction force can be generated at the suction section 193.

The humidifying section 236 is disposed downstream of the loosening section 18. The humidifying section 236 includes an ultrasonic humidifier similar to the humidifying section 235. Thereby, moisture can be supplied to the second web M8, and thus the content of moisture of the second web M8 is adjusted. By the adjustment, adsorption of the second web M8 to the mesh belt 191 due to electrostatic force can be prevented. Thereby, the second web M8 is easily peeled from the mesh belt 191 at a position where the mesh belt 191 is folded back by the tension rollers 192.

The total content of moisture added from the humidifying section 231 to the humidifying section 236 is preferably 0.5 parts by mass or more and 20 parts by mass or less with respect to 100 parts by mass of the material before humidification, for example.

The sheet forming section 20 is disposed downstream of the second web forming section 19. The sheet forming section 20 performs the sheet forming process of forming the sheet S from the second web M8. The sheet forming section 20 has a pressurizing section 201 and a heating section 202.

The pressurizing section 201 has a pair of calender rollers 203 and can pressurize the web M8 between the calender rollers 203 without heating the second web M8. Thereby, the density of the second web M8 is increased. As an extent of the heating in this case, for example, it is preferable that the resin P1 is not melted. The second web M8 is transported toward the heating section 202. Note that, one of the pair of calender rollers 203 is a main driving roller which is driven by the operation of a motor (not shown), and the other is a driven roller.

The heating section 202 has a pair of heating rollers 204 and can pressurize the web M8 between the heating rollers 204 while heating the second web M8. By the heat and pressure, the resin P1 is melted in the second web M8, and the fibers are bound to each other via the melted resin P1. Thereby, the sheet S is formed. The sheet S is transported toward the cutting section 21. Note that, one of the pair of heating rollers 204 is a main driving roller which is driven by the operation of a motor (not shown), and the other is a driven roller.

The cutting section 21 is disposed downstream of the sheet forming section 20. The cutting section 21 performs the cutting process of cutting the sheet S. The cutting section 21 has a first cutter 211 and a second cutter 212.

The first cutter 211 cuts the sheet S in a direction that intersects with the transport direction of the sheet S, particularly in a direction orthogonal thereto.

The second cutter 212 cuts the sheet S in a direction parallel to the transport direction of the sheet S on the downstream of the first cutter 211. The cutting is a process of removing unnecessary portions at both end portions of the sheet S, that is, the end portions in the +y axis direction and the −y axis direction to adjust the width of the sheet S. In addition, the portion that has been removed by the cutting is referred to as a so-called "edge".

By cutting the first cutter 211 and the second cutter 212 as described above, the sheet S having a desired shape and size can be obtained. The sheet S is transported further downstream and accumulated in the stock section 22.

Each section included in such a sheet manufacturing apparatus 100 is electrically coupled to the controller 28. The operations of these sections are controlled by the controller 28.

The controller 28 has a central processing unit (CPU) 281 and a storage section 282. For example, the CPU 281 can make various determinations, various commands, and the like.

The storage section 282 stores various programs, such as a program for manufacturing the sheet S, various calibration curves, a table, and the like.

The controller 28 may be built in the sheet manufacturing apparatus 100 or may be provided in an external device such as an external computer. In some cases, the external device communicates with the sheet manufacturing apparatus 100 via a cable or the like, or wirelessly communicates therewith. For example, the external device is coupled to the sheet manufacturing apparatus 100 via a network such as the Internet.

Further, for example, the CPU 281 and the storage section 282 may be integrated as a single section, the CPU 281 may be built in the sheet manufacturing apparatus 100 and the storage section 282 may be provided in an external device such as an external computer, or the storage section 282 may be built in the sheet manufacturing apparatus 100 and the CPU 281 may be provided in an external device such as an external computer.

Next, the additive supply device 3 and the additive container 4 will be described.

As shown in FIGS. 2 and 3, the additive container 4 is attachably and detachably mounted on the additive supply device 3. Then, in the state where the additive container 4 is mounted on the additive supply device 3, by rotating the additive container 4 with respect to the additive supply device 3, the resin P1 in the additive container 4 can be supplied to the housing 170 shown in FIG. 1 via the additive supply device 3.

First, the additive container 4 will be described.

As shown in FIG. 2, the additive container 4 has a container 45 that has a container body 41 and a mouth member 42, and that contains the resin P1 as an additive therein, and a first shutter member 43. The additive container 4 is mounted on the additive supply device 3 in the state where the first shutter member 43 is directed downward in the vertical direction.

The container body 41 is a bottomed cylindrical member and has a handle 411 on the side portion of the container body. The handle 411 is hollow and can contain the resin P1 therein. The constituent material of the container body 41 is not particularly limited. Examples of the constituent material include resin materials such as polyolefin such as polyethylene, polypropylene, an ethylene-propylene copolymer, or an ethylene-vinyl acetate copolymer (EVA), polyvinyl chloride, polyvinylidene chloride, polystyrene, polyamide, polyimide, polyamideimide, polycarbonate, polymethyl methacrylate, an acrylonitrile-butadiene-styrene copolymer (ABS resin), an acrylonitrile-styrene copolymer (AS resin), a butadiene-styrene copolymer, polyoxymethylene, polyvinyl alcohol (PVA), an ethylene-vinyl alcohol copolymer (EVOH), and polyester such as polyethylene terephthalate (PET), polybutylene terephthalate (PBT), polycyclohexane terephthalate (PCT), and the like. Further, it is desirable that the container body 41 has optical transparency. Thereby, the remaining amount of the resin P1 in the container body can be visually checked.

The mouth member 42 is a cylindrical member provided in the opening of the container body 41. The mouth member 42 has a discharge port 420 through which the resin P1 in the container body 41 is discharged. The discharge port 420 is an end portion or end surface on the side opposite to the container body 41 out of both end portions or both end surfaces of the mouth member 42. Therefore, in this specification, the discharge port 420 is a concept including both an opened portion and a closed portion, as will be described later.

As shown in FIG. 4, the discharge port 420 has an opening portion 421 as a second opening portion through which the resin P1 passes and a shielding portion 422 as a second shielding portion that does not allow the resin P1 to pass therethrough. In the present embodiment, two opening portions 421 are provided, and are located on the opposite sides with respect to the central axis O of the discharge port 420, that is, the central axis O of the mouth member 42. Meanwhile, in the present embodiment, two shielding portions 422 are also provided, and are located on the opposite sides with respect to the central axis O. The opening portions 421 and shielding portions 422 are alternately provided around the central axis O. Further, when viewed from the central axis O direction, the opening portions 421 and the shielding portions 422 each have a fan shape, and the central angle is about 90°.

As shown in FIG. 4, the side portion of the mouth member 42 is dented in two places toward the central axis O side. Therefore, two ridgelines 423 extending toward the central axis O are formed inside the mouth member 42. The ridgelines 423 are inclined so as to approach the discharge port 420 as the ridgelines are directed toward the central axis O side. A pair of the ridgelines 423 are formed on the opposite sides with respect to the central axis O.

Inclined surfaces inclined from the ridgelines 423 toward the opening portion 421 function as guide surfaces 424. The guide surfaces 424 are disposed on both sides of each opening portion 421, respectively, and in the present embodiment, four guide surfaces are provided. The guide surfaces 424 are inclined with respect to the surface including the discharge port 420. The guide surface 424 is a guide portion that guides the resin P1 that is the additive in the container 45 to the opening portion 421 that is the second opening portion. Thereby, the resin P1 can be smoothly discharged.

Further, the inclination angle of each guide surface 424 with respect to the surface including the discharge port 420 may be larger than the angle of repose of the resin P1 in the container 45. Thereby, this contributes to smoother discharge. Since the angle of repose changes depending on various conditions such as the composition of the additive and the particle diameter, the inclination angle can be set as appropriate according to the type of the additive used.

Further, as shown in FIG. 4, the mouth member 42 has protruding pieces 425 provided on the side portion thereof and protruding toward the outer peripheral side of the mouth member. The protruding piece 425 is inserted into a groove 54 which will be described later and moves in the groove 54. A pair of the protruding pieces 425 are formed on the opposite sides with respect to the central axis O.

Further, protrusions 426 that protrude along the central axis O direction are provided on the surfaces of the protruding pieces 425 on the first shutter member 43 side. The protrusions 426 are inserted into hole portions 435 of the first shutter member 43. This will be described later.

As shown in FIGS. 4 and 5, the shielding portions 422 are connected at the central portion, and an insertion hole 427 into which a protrusion 433 of the first shutter member 43 is inserted is formed in the connected portion.

Examples of the constituent material of the mouth member 42 include various hard resin materials, various metal materials, and the like. Further, the container body 41 and the mouth member 42 may be integrally formed, and may be separately configured so that the container body and the mouth member are attachable and detachable. Examples of the attachment and detachment mechanism include screwing and fitting.

Thus, the container 45 has the container body 41 and the mouth member 42 having the discharge port 420. As the container body 41 and the mouth member 42 are separately configured, for example, when the resin P1 in the container body is used up, it is possible to refill the container body 41 with the resin P1 by detaching the container body 41 or to replace with another container body 41 filled with the resin P1 or the like.

As shown in FIG. 5, the first shutter member 43 has a function of opening and closing the discharge port 420. The first shutter member 43 has a disk shape and is mounted on the discharge port 420 side of the mouth member 42. The first shutter member 43 has an opening portion 431 as a first opening portion through which the resin P1 passes and a shielding portion 432 as a first shielding portion that does not allow the resin P1 to pass therethrough. In the present embodiment, two opening portions 431 are provided, and are located on the opposite sides with respect to the central axis O, that is, the central axis O of the first shutter member 43. Meanwhile, in the present embodiment, two shielding portions 432 are also provided, and are located on the opposite sides with respect to the central axis O of the first shutter member 43. The opening portions 431 and shielding portions 432 are alternately provided around the central axis O of the first shutter member 43, that is, around the rotation axis. Further, when viewed from the central axis O direction of the first shutter member 43, the opening portions 431 and the shielding portions 432 each have a fan shape, and the central angle is about 90°. With such a configuration, it is possible to sufficiently secure the supply amount of the resin P1 in an open state while reducing the amount of rotation necessary to enter the open state.

The opening portion 431 has the same shape and the same opening area as the opening portion 421 of the discharge port 420. Meanwhile, the shielding portion 432 has the same shape and the same area as the shielding portion 422 of the discharge port 420.

The first shutter member 43 has the protrusion 433 that is provided at the central portion and on the mouth member 42 side, and that protrudes toward the mouth member 42 side. The protrusion 433 is inserted into the insertion hole 427 of the mouth member 42, and is supported so as to be rotatable around the central axis O.

Further, the first shutter member 43 has a pair of protruding pieces 434 formed on the outer peripheral portion thereof so as to protrude toward the outer peripheral side. The protruding piece 434 has the hole portion 435 into which the protrusion 426 of the mouth member 42 and a protrusion 522 of a support member 52 which will be described later are inserted. In a state where the protrusion 426 of the mouth member 42 is inserted into the hole portion 435, the first shutter member 43 and the mouth member 42 can be restricted from rotating unintentionally. That is, the protrusion 426 of the mouth member 42 and the hole portion 435 of the first shutter member 43 constitute a rotation restricting portion that restricts unintentional rotation in the detached state.

Further, when the mounted state is set, the protrusion 522 of the support member 52 is inserted into the hole portion 435 of the first shutter member 43. During the insertion, the protrusion 522 is inserted from the side opposite to the side where the protrusion 426 of the mouth member 42 is inserted, and pushes the protrusion 426 of the mouth member 42 to the outside of the hole portion 435. Thereby, the first shutter member 43 and the mouth member 42 enter a relatively rotatable state. Further, in the state where the protrusion 522 of the support member 52 is inserted into the hole portion 435 of the first shutter member 43, the first shutter member 43 is restricted from rotating with respect to the additive supply device 3.

Such a first shutter member 43 can rotate around the central axis O with respect to the mouth member 42. Thereby, when viewed from the central axis O direction, the state in which the opening portion 431 of the first shutter member 43 and the opening portion 421 of the discharge port 420 overlap each other, and the state in which the opening portion 431 of the first shutter member 43 and the opening portion 421 of the discharge port 420 are shifted from each other can be taken.

The additive container 4 enters the open state in which the resin P1 is discharged via the opening portion 421 and the opening portion 431 in the state where the opening portion 431 and the opening portion 421 overlap each other. Then, the additive container 4 enters the closed state in which the opening portion 421 is closed by the shielding portion 432 and the resin P1 is not discharged in the state in which the opening portion 431 and the opening portion 421 are shifted from each other.

Thus, the discharge port 420 can be opened and closed by the first shutter member 43 rotating with respect to the mouth member 42. Thereby, for example, when the open state is changed to the closed state while the resin P1 remains in the container 45, that is, the resin P1 is being discharged, the first shutter member 43 can enter a closed state by scraping the resin P1 discharged from the opening portion 421 of the mouth member 42. Therefore, when the closed state is set, the resin P1 can be made difficult to adhere to the outer surface of the first shutter member 43. Even though the resin P1 remains, when the closed state is set, the additive container 4 can be detached from the additive supply device 3 and replaced with, for example, an additive container that contains another additive. Further, at that time, since the resin P1 is not adhered or substantially not adhered to the first shutter member 43, the resin P1 can be prevented or suppressed from being scattered in the atmosphere.

A seal member 44 is provided between the first shutter member 43 and the mouth member 42. In the present embodiment, the seal member 44 has a shape that surrounds the edges of the two opening portions 421 over the entire circumference. When the first shutter member 43 opens and closes the discharge port 420, the seal member 44 can prevent or suppress the additive from entering between the mouth member 42 and the first shutter member 43 in the open state. Furthermore, the effect that the resin P1 hardly adheres to the outer surface of the first shutter member 43 as described above can be more remarkably obtained.

The seal member 44 may be fixed to either the mouth member 42 or the first shutter member 43, but is desirably fixed to the mouth member 42. Thereby, the seal member 44 can effectively prevent that rotation of the first shutter member 43 is inhibited.

The constituent material of the seal member 44 is not particularly limited, but is desirably made of an elastic body such as rubber. Thereby, the above effect can be more remarkably exhibited.

The seal member 44 is desirably installed so as to protrude from the shielding portion 422 of the discharge port 420 toward the first shutter member 43 side. Thereby, the above effect can be more remarkably exhibited.

Next, the additive supply device 3 will be described.

As shown in FIG. 1, the additive supply device 3 is installed in housing 170 of the additive supply section 171, and the additive container 4 is attachably and detachably mounted on the additive supply device 3. As shown in FIGS. 6 and 7, the additive supply device 3 has a mounting portion 5 that communicates with the housing 170 and that has an intake port 50 for introducing the resin P1, a cover member 6 that covers the intake port 50, a second shutter member 7, an urging section 70, a lock mechanism 8, and a notification mechanism 9.

The mounting portion 5 has a cylindrical port 51 that communicates with the housing 170, the support member 52 that is installed on the upper portion of the port 51 and that supports the additive container 4 in the mounted state, and a groove forming member 53 provided on the support member 52. The port 51 has an opening at the top, and this opening constitutes the intake port 50. The resin P1 is supplied to the additive supply section 171 via the intake port 50.

The support member 52 is installed on the upper portion of the port 51. As shown in FIG. 8, the support member 52 has a plate-shaped main body 521 having an opening 520, the protrusion 522, and a seal member 523.

The opening 520 has an opening portion 520A through which the resin P1 passes and a shielding portion 520B that does not allow the resin P1 to pass therethrough. In the present embodiment, two opening portions 520A and two shielding portions 520B are provided, and are located on the opposite sides with respect to the central axis of the opening 520. The opening portions 520A and shielding portions 520B are alternately provided around the central axis of the opening 520. Further, when viewed from the central axis direction of the opening 520, the opening portions 520A and the shielding portions 520B each have a fan shape, and the central angle is about 90°.

The opening portion 520A is configured to overlap and communicate with the opening portion 431 of the first shutter member 43 when the first shutter member 43 is in the open state.

The protrusion 522 is provided on the surface of the main body 521 opposite to the port 51, and a pair of the protrusions 522 are provided on the opposite sides with respect to the central axis of the opening 520. The protrusion 522 has a function of restricting the first shutter member 43 from rotating with respect to the additive supply device 3 by being inserted into and engaged with the hole portion 435 of the first shutter member 43.

Further, as described above, when the mounted state is set, the protrusion 522 is inserted from the side opposite to the side where the protrusion 426 of the mouth member 42 is inserted, and pushes the protrusion 426 of the mouth member 42 to the outside of the hole portion 435. Thereby, the first shutter member 43 and the mouth member 42 enter a relatively rotatable state. That is, the protrusion 522 has a function of releasing the state where the first shutter member 43 is restricted from rotating with respect to the additive supply device 3 and a function of restricting the first shutter member 43 from rotating with respect to the additive supply device 3.

As shown in FIG. 8, the seal member 523 is provided on the surface of the main body 521 opposite to the port 51 and is provided so as to surround the entire circumference of the edge of the opening 520. Further, the constituent material of the seal member 44 described above is not particularly limited, but the constituent material of the seal member 523 is desirably made of an elastic body such as rubber. Thereby, in the mounted state, the opening 520 and the opening portion 431 of the first shutter member 43 can be communicated in an airtight manner, and the outflow of the resin P1 can be prevented. Furthermore, since the seal member 523 is an elastic body, it can cover a part of the notification mechanism 9 as described later.

The groove forming member 53 has a plate shape having an opening portion 530 and is a member disposed on the upper surface of the support member 52, that is, on the surface opposite to the port 51. The groove forming member 53 has a shape in which the edge of the surface on the support member 52 side protrudes to the support member 52 side. Thereby, as shown in FIGS. 6 and 7, a groove 54 is formed between the support member 52 and the groove forming member 53. As shown in FIGS. 11 and 12, a pair of the grooves 54 are provided, and extend along the circumferential direction of the intake port 50.

The respective grooves 54 are provided over substantially ¼ circumference, and are located on the opposite sides with respect to the central axis of the intake port 50. Each groove 54 is a part where the protruding piece 425 of the mouth member 42 moves along the extending direction inside the groove 54. When the protruding piece 425 comes into contact with a wall portion 541 which is the inner wall surface of the end portion of the groove 54, the rotation limit of the mouth member 42 is restricted, and in this state, the additive container 4 enters the open state.

Further, in the vicinity of the wall portion 541 of the groove 54, a concave portion 542 that communicates with the groove 54 and is cut out upward, that is, toward the cover member 6 is provided. For the concave portion 542, when the protruding piece 425 of the mouth member 42 rotates to the rotation limit, that is, when the protruding piece 425 comes into contact with the wall portion 541, the protruding piece is pushed up into the concave portion 542 by the restoring force of the seal member 523, that is, the elastic force. This will be described in detail later. When the protruding piece 425 comes into contact with the inner surface of the concave portion 542 by this push-up, vibration is generated. By this vibration, the operator can recognize that the rotation of the additive container 4 has reached the rotation limit, that is, the first shutter member 43 has entered the open state.

Thus, the protruding piece 425, the seal member 523, and the concave portion 542 constitute the notification mechanism 9 that notifies that the first shutter member 43 has entered the open state in the mounted state. Thereby, the operator can recognize that the first shutter member 43 has entered the open state, and can prevent the additive container 4 from rotating excessively.

The groove forming member 53 has a guide groove 531 as shown in FIG. 8. A pair of the guide grooves 531 are provided on the opposite sides with respect to the central axis of the intake port 50. The guide groove 531 is formed at a position facing the opening portion 530 on the inner surface of the groove forming member 53. The guide groove 531 is provided over the entire region in the thickness direction of the groove forming member 53.

The guide groove 531 has a function of entering and guiding the protruding piece 434 of the first shutter member 43 and the protruding piece 425 of the mouth member 42 in an engaged state. Further, the lower end portion of the guide groove 531 communicates with the groove 54, and the above-described protrusion 522 is installed on this communicating portion, that is, the bottom portion.

As the protruding piece 434 of the first shutter member 43 and the protruding piece 425 of the mouth member 42 that are guided to the guide groove 531 are disengaged by the protrusion 522, and the protruding piece 434 of the first shutter member 43 is fixed, the protruding piece 425 of the mouth member 42 can move in the groove 54, that is, the mouth member 42 can rotate.

The support member 52 and the groove forming member 53 may be integrally configured.

As shown in FIGS. 6 and 7, the cover member 6 covers the intake port 50 together with the support member 52 and the groove forming member 53. The cover member 6 has a box shape, and an insertion port 61 into which the additive container 4 is inserted is formed on the cover member 6. The lower portion of the cover member 6 is fixed to the edge of the intake port 50 of the port 51 in an airtight manner.

The second shutter member 7 that opens and closes the insertion port 61 is installed on the upper inside of the cover member 6. In the present embodiment, two second shutter members 7 are installed, and are provided on the opposite sides with respect to the central axis of the insertion port 61. In the closed state, these two second shutter members 7 close the entire surface of the insertion port 61 when viewed from the central axis side of the insertion port 61 in a posture along the opening surface of the insertion port 61. In the closed state, the end portions of the second shutter members 7 are in close contact with the central portion of the insertion port 61.

Since the intake port 50 is covered with the cover member 6 as described above, by closing the insertion port 61, the intake port 50 can be substantially closed and enter the closed state.

The second shutter member 7 is coupled to a rotation shaft 71 and can rotate around the rotation shaft 71 in the arrow direction in FIG. 7. In this rotating state, the insertion port 61 can be opened and the intake port 50 can enter the open state.

Further, when the additive container 4 is inserted into the cover member 6 from the first shutter member 43 side via the insertion port 61, the additive container 4 rotates the second shutter member 7 and the second shutter member 7 can enter the open state.

Thus, since the second shutter member 7 is configured to open and close the insertion port 61 by rotating, and to open and close the intake port 50, when inserting the additive container 4 into the insertion port 61, the second shutter member 7 can be opened and closed at the same timing.

The additive supply device 3 includes the cover member 6 that covers the intake port 50, and the second shutter member 7 is provided on the cover member 6, so that the second shutter member 7 can rotate downward.

Further, the second shutter member 7 is urged by the urging section 70 toward the closed state, that is, in the direction opposite to the arrow in FIG. 7. As the urging section 70, for example, a coil spring provided on the rotation shaft 71 can be used.

Thus, the additive supply device 3 has the urging section 70 that urges the second shutter member 7 in the direction in which the second shutter member 7 closes the intake port 50. Accordingly, from the state shown in FIG. 7, when the additive container 4 is removed from the cover member 6, that is, when the additive container 4 is detached, the second shutter member 7 can return to the closed state shown in FIG. 6 by the urging force of the urging section 70. Thus, since the second shutter member 7 enters the closed state at the same timing as the operation of detaching the additive container 4, even though the resin P1 exists inside the cover member 6, the second shutter member 7 can prevent or suppress the resin P1 from being scattered in the atmosphere, that is, outside the cover member 6.

As shown in FIGS. 2 and 3, the additive supply device 3 has the lock mechanism 8. The lock mechanism 8 maintains the closed state of the second shutter member 7 and has a pair of engagement pieces 81 in the present embodiment. Each engagement piece 81 is provided on the upper portion of the cover member 6 and at the edge of the insertion port 61. The respective engagement pieces 81 are provided on the opposite sides with respect to the central axis of the insertion port 61, and a line segment connecting each engagement piece 81 is installed along the boundary between the two second shutter members 7.

As shown in FIG. 15, each engagement piece 81 opens downward and has a concave portion 811 into which the side wall of the cover member 6 is inserted, and a concave portion 812 into which the second shutter member 7 is inserted. The concave portion 812 is open to the insertion port 61 side, and is installed so as to sandwich the end portions of the two second shutter members 7 in the thickness direction. In a state where each second shutter member 7 is located in the concave portion 812, the second shutter member 7 can enter a locked state in which the rotation is restricted by the inner surface of the concave portion 812.

Further, the engagement piece 81 has an inclined surface 813 that is inclined toward the insertion port 61 on the upper portion of the engagement piece 81. The inclined surface 813 functions as a guide portion that guides the additive container 4 to the insertion port 61. Each engagement piece 81 is provided above the guide groove 531 described above.

When the additive container 4 is to be inserted into the insertion port 61, firstly, the protruding piece 434 of the first shutter member 43 slides on the inclined surface 813 and the additive container 4 is guided to the insertion port 61. At this time, the side wall of the cover member 6 on which the engagement piece 81 is installed is bent and deformed, and the engagement pieces 81 move in a direction away from each other, that is, in a direction away from the central axis of the insertion port 61. Thereby, the second shutter member 7 in the concave portion 812 is located outside the concave portion 812, the locked state is released, and the second shutter member 7 enters a rotatable state.

Thus, the additive supply device 3 further includes the lock mechanism 8 that maintains the closed state of the second shutter member 7. Further, each engagement piece 81 of the lock mechanism 8 can move between a first position that engages with the second shutter member 7 to restrict movement of the second shutter member 7 and a second position where the engagement with the second shutter member 7 is released and the movement of the second shutter member 7 is allowed. Thereby, it is possible to switch between a locked state and an unlocked state in which the locked state is released. Further, since it can enter the locked state in the detached state, even if an unintentional external force is applied to the second shutter member 7 in the detached state, it is possible to prevent the second shutter member 7 from entering the open state.

Next, how to use the additive supply device 3 and the additive container 4 will be described.

First, as shown in FIG. 2, the additive container 4 is approached from above the second shutter member 7. At this time, the additive container 4 is placed in a state where the first shutter member 43 faces downward, and the protruding pieces 434 of the first shutter member 43 are located above the engagement pieces 81 of the lock mechanism 8 respectively.

In this state, the first shutter member 43 and the second shutter member 7 remain closed. Further, as shown in FIG. 15, the protrusion 426 formed on the protruding piece 425 of the mouth member 42 is inserted into the hole portion 435 formed in the protruding piece 434 of the first shutter member 43. In this state, unintentional rotation of the first shutter member 43 is prevented. That is, it can be said that the hole portion 435 formed in the protruding piece 434 of the first shutter member 43 and the protrusion 426 formed on the protruding piece 425 of the mouth member 42 constitute a first shutter member side lock mechanism.

When the additive container 4 is further moved downward in this posture, the protruding piece 434 of the first shutter member 43 slides on the inclined surface 813 as shown in FIG. 15, the side wall of the cover member 6 on which the engagement piece 81 is installed is bent and deformed, and the respective engagement pieces 81 move in directions away from each other. Thereby, the second shutter member 7 in the concave portion 812 is located outside the concave portion 812, the locked state is released, and the second shutter member 7 enters a rotatable state.

Then, as shown in FIG. 7, when the additive container 4 is further moved downward, the first shutter member 43 rotates the second shutter member 7 against the urging force of the urging section 70. As a result, the second shutter member 7 enters the open state.

As shown in FIG. 8, when the second shutter member 7 enters the open state, the protruding piece 434 of the first shutter member 43 is guided downward within the guide groove 531 of the groove forming member 53. Then, when the first shutter member 43 is moved downward until it comes into contact with the support member 52, the protrusion 522 of the support member 52 enters the hole portion 435 of the protruding piece 434 of the first shutter member 43 so that the first shutter member 43 is restricted from rotating with respect to the additive supply device 3 as shown in FIGS. 9 and 10. The mounted state is maintained in this state.

At this time, the protrusion 522 is inserted from the side opposite to the side where the protrusion 426 of the mouth member 42 is inserted, and pushes the protrusion 426 of the mouth member 42 to the outside of the hole portion 435. Thereby, the first shutter member 43 and the mouth member 42 enter a relatively rotatable state.

At this time, the second shutter member 7 comes into contact with the container 45 of the additive container 4 and the state where the second shutter member 7 is rotated by the container 45 is maintained.

Then, when the additive container 4 is rotated in the arrow direction in FIG. 3, that is, in a first direction, the protruding piece 425 moves in the groove 54. At this time, since the first shutter member 43 is fixed, the first shutter member 43 and the container 45 rotate relative to each other. Then, as shown in FIG. 12, when the protruding piece 425 rotates until it comes into contact with the wall portion 541 of the groove 54 from the state shown in FIG. 11, the opening portion 431 of the first shutter member 43 and the opening portion 421 of the mouth member 42 are overlapped as much as possible, and the discharge port 40 can enter the open state. Therefore, the resin P1 can be supplied to the intake port 50 via the discharge port 40.

When the protruding piece 425 moves in the groove 54, the first shutter member 43 and the mouth member 42 press the seal member 523 that is an elastic body so as to compress it in the thickness direction. Therefore, the mouth member 42 is urged by the restoring force of the seal member 523 in the direction away from the intake port 50, that is, on the upper side in FIGS. 13 and 14, via the first shutter member 43.

Therefore, when the protruding piece 425 rotates until it comes into contact with the wall portion 541 of the groove 54, the protruding piece is pushed up into the concave portion 542 communicating with the groove 54 as shown in FIG. 14. When the protruding piece 425 comes into contact with the inner surface of the concave portion 542 by this push-up, vibration is generated. By this vibration, the operator can recognize that the rotation of the additive container 4 has reached the rotation limit, that is, the first shutter member 43 has entered the open state.

When the open state is changed to the closed state, the additive container 4 is rotated toward the side opposite to the arrow direction in FIG. 2, that is, in a second direction while being pressed against the mounting portion 5 side. Thereby, the protruding piece 425 moves in the groove 54 in the direction opposite to the direction described above. When the protruding piece 425 reaches the guide groove 531 of the groove forming member 53, the additive container 4 can be removed along the guide groove 531.

Further, when the additive container 4 is removed from the cover member 6, the second shutter member 7 rotates in a direction to close the insertion port 61 by the urging force of the urging section 70. Thereby, the second shutter member 7 enters the closed state. Thus, since the second shutter member 7 can be rotated by the operation of moving the additive container 4 in the vertical direction, the intake port 50 can be easily opened and closed.

As described above, the additive container 4 is an additive container that contains the additive to be added to the defibrated material therein and that can be coupled to the intake port of the additive supply device 3. The additive container 4 includes the container 45 that has the discharge port 420 and that contains the additive, and the first shutter member 43 that opens and closes the discharge port 420. Then, the first shutter member 43 enters the open state by rotating the container 45 in the first direction around the central axis of the discharge port 420 with respect to the first shutter member 43, and the first shutter member 43 enters the closed state by rotating the container 45 in the second direction opposite to the first direction with respect to the first shutter member 43 from the open state.

According to such an additive container 4, for example, when the open state is changed to the closed state while the resin P1 remains in the container 45, that is, the resin P1 is being discharged, the first shutter member 43 can enter a closed state by scraping the resin P1 discharged from the opening portion 421 of the mouth member 42. Therefore, when the closed state is set, the resin P1 can be made difficult to adhere to the outer surface of the first shutter member 43. Even though the resin P1 remains, when the closed state is set, the additive container 4 can be detached from the additive supply device 3 and replaced with, for example, an additive container that contains another additive. Further, at that time, since the resin P1 is not adhered or substantially not adhered to the first shutter member 43, the resin P1 can be prevented or suppressed from being scattered in the atmosphere.

The first shutter member 43 has the opening portion 431 as a first opening portion through which the resin P1 passes and the shielding portion 432 as a first shielding portion that does not allow the resin P1 to pass therethrough. The discharge port 420 has the opening portion 421 as a second opening portion through which the resin P1 passes and the shielding portion 422 as a second shielding portion that does not allow the resin P1 to pass therethrough.

Thereby, as described above, the operation of opening and closing the discharge port 420 can be performed.

The discharge port 420 enters the open state in a state where the opening portion 431 as the first opening portion overlaps the opening portion 421 as the second opening portion, and the discharge port 420 enters the closed state in a state where the opening portion 431 is shifted from the opening portion 421.

Thereby, as described above, the operation of opening and closing the discharge port 420 can be performed.

Hereinbefore, the additive container according to the present disclosure has been described with reference to the illustrated embodiment, but the present disclosure is not limited thereto and each section constituting the additive container can be replaced with any section that can implement the same function. Further, any components may be added.

In the above-described embodiment, the second shutter member is configured to open and close the supply port by rotation. However, the present disclosure is not limited thereto. For example, the second shutter member may be configured to open and close the supply port by the rotation or a slide type that reciprocates in one direction. Further, by providing a detection section which detects that the second shutter member has entered the detached state, it may be configured to open and close the second shutter member based on the detection result.

What is claimed is:

1. An additive container configured to contain an additive to be added to a defibrated material therein and to be coupled to an intake port for introducing the additive of an additive supply device, the additive container comprising:

a container that includes a discharge port and contains the additive, the container further including a pair of first protruding pieces protruding outward from an outer peripheral side of the container, each of the first protruding pieces having a first protrusion that protrudes along a central axis of the discharge port; and a first shutter member that opens and closes the discharge port, the first shutter member including a pair of second protruding pieces protruding outward from an outer peripheral side of the first shutter member, each of the second protruding pieces having a first surface, a second surface that faces in an opposite direction of the first surface, and a hole that penetrates through each of the second protruding pieces from the first surface to the second surface, wherein the first shutter member enters an open state by rotating the container in a first direction around the central axis of the discharge port with respect to the first shutter member, and the first shutter member enters a closed state by rotating the container in a second direction opposite to the first direction with respect to the first shutter member from the open state, the first protrusion and the hole restrict the first shutter member from rotating with respect to the container by the first protrusion being coupled to the hole from a side of the first surface, the hole further restricts the first shutter member from rotating with respect to the additive supply device having a pair of second protrusions, by each second protrusion of the additive supply device being coupled to the hole from a side of the second surface, the first protrusion which is being coupled to the hole is pushed outside of the hole by the each second protrusion in response to the each second protrusion being coupled to the hole from the side of the second surface, and in a state where the rotation of the first shutter member with respect to the additive supply device is restricted by the hole being coupled to the each second protrusion, as the container is operated to rotate relative to the first shutter member, the open state and the closed state are switched.

2. The additive container according to claim 1, wherein the first shutter member includes a first opening portion that allows the additive to pass therethrough, and a first shielding portion that shields the additive, and the discharge port includes a second opening portion that allows the additive to pass therethrough, and a second shielding portion that does not allow the additive to pass therethrough.

3. The additive container according to claim 2, wherein the additive container enters the open state in a state where the first opening portion overlaps with the second opening portion, and the additive container enters the closed state in a state where the first opening portion is shifted from the second opening portion.

4. The additive container according to claim 2, wherein a plurality of the first opening portions and a plurality of the first shielding portions are alternately provided around a rotation axis of the first shutter member, and a plurality of the second opening portions and a plurality of the second shielding portions are alternately provided around a central axis of the discharge port.

5. The additive container according to claim 2, wherein the container includes a guide portion that guides the additive in the container to the second opening portion.

6. The additive container according to claim 5, wherein the guide portion is an inclined surface inclined toward the second opening portion.

7. The additive container according to claim 1, wherein the additive includes a binder that bonds fibers to each other.

8. The additive container according to claim 1, wherein the container includes a container body and a mouth member having the discharge port.

* * * * *